US008087366B2

(12) United States Patent
Fujihara

(10) Patent No.: US 8,087,366 B2
(45) Date of Patent: Jan. 3, 2012

(54) NEEDLE THREADER FOR SEWING MACHINE

(75) Inventor: Shinya Fujihara, Ichinomiya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 462 days.

(21) Appl. No.: 12/320,056

(22) Filed: Jan. 15, 2009

(65) Prior Publication Data

US 2009/0183663 A1 Jul. 23, 2009

(30) Foreign Application Priority Data

Jan. 18, 2008 (JP) ..... 2008-009315
Jan. 18, 2008 (JP) ..... 2008-009316

(51) Int. Cl.
*D05B 87/02* (2006.01)
*D05B 85/00* (2006.01)

(52) U.S. Cl. ..... 112/225

(58) Field of Classification Search ..... 112/225, 112/302, 220, 221; 223/99
See application file for complete search history.

(56) References Cited

U.S. PATENT DOCUMENTS

| | | | | |
|---|---|---|---|---|
| 5,615,629 | A * | 4/1997 | Yamada et al. | 112/225 |
| 6,067,919 | A * | 5/2000 | Shoji | 112/225 |
| 6,564,731 | B2 * | 5/2003 | Sano et al. | 112/225 |
| 7,281,479 | B2 | 10/2007 | Watanabe et al. | |
| 7,444,949 | B2 * | 11/2008 | Park et al. | 112/225 |
| 7,448,336 | B2 * | 11/2008 | Wacker et al. | 112/225 |

FOREIGN PATENT DOCUMENTS

| | | |
|---|---|---|
| JP | A-2002-200387 | 7/2002 |
| JP | A-2006-158412 | 6/2006 |

* cited by examiner

*Primary Examiner* — Ismael Izaguirre
(74) *Attorney, Agent, or Firm* — Oliff & Berridge, PLC

(57) ABSTRACT

A needle threader for a sewing machine includes a threading mechanism including a threading hook mounted on a lower end of a threading shaft and a thread guide member. The threading hook and the thread guide member are movable among a thread guide preparation position where the threading hook and the thread guide member are located near a height position of a needle clamp, a threading operation position where a threading operation is carried out with the threading hook being level with an eye of a needle, and a retreat position which is located above the thread guide preparation position and to which the threading hook and the thread guide member are retreated. A vertical moving mechanism moves the threading shaft vertically so that the threading mechanism is moved among the thread guide preparation position, the threading operation position and the retreat position.

14 Claims, 25 Drawing Sheets

| USER'S OPERATION | MOTOR OPERATION | CONDITION OF THREADING |
|---|---|---|
| PRESSING THREADING KEY ONCE | | |
| ↓ | DRIVING THREADING LEVER DOWNWARD BY a | THREADING MECHANISM HAS BEEN MOVED TO THREAD GUIDE PREPARATION POSITION |
| PASSING THREAD THROUGH THREADING MECHANISM | ↓ | THREADING PREPARATION COMPLETED |
| ↓ | ↓ | |
| PRESSING THREADING KEY ONCE | ↓ | |
| | DRIVING THREADING LEVER DOWNWARD BY b+c | |
| | ↓ | THREADING COMPLETED |
| SEWABLE AFTERWARD | DRIVING THREADING LEVER UPWARD BY a+b+c | THREADING MECHANISM HAS BEEN RETURNED TO RETREAT POSITION |

FIG. 8

| USER'S OPERATION | MOTOR OPERATION | CONDITION OF THREADING |
|---|---|---|
| | | |
| | CONTRLLING SO THAT a PART IS NOT USED | ON STANDBY AT THREAD GUIDE PREPARATION POSITION |
| PASSING THREAD THROUGH THREADING MECHANISM | | THREADING PREPARATION COMPLETED |
| ↓ | | |
| PRESSING THREADING BUTTON ONCE | | |
| | DRIVING THREADING LEVER DOWNWARD BY b+c | |
| | ↓ | THREADING COMPLETED |
| SEWABLE AFTERWARD | DRIVING THREADING LEVER UPWARD BY a+b+c | THREADING MECHANISM HAS BEEN RETURNED TO THREAD GUIDE PREPARATION POSITION |

FIG.10

NEEDLE THREADER FOR SEWING MACHINE

This application is based upon and claims the benefit of priority from the prior Japanese Patent Application Nos. 2008-009315 and 2008-009316 both filed on Jan. 18, 2008, the entire contents of which are incorporated herein by reference.

BACKGROUND

1. Technical Field

The present disclosure relates to a needle threader for a sewing machine, which is provided in a head of a sewing machine body for threading a sewing machine needle mounted on a lower end of a needlebar by causing a needle thread from a needle thread supply to pass through an eye of the needle.

2. Description of the Related Art

Needle threaders of the above-described type have conventionally been known. For example, Japanese patent application publication JP-A-2002-200387 discloses a needle threader provided with a threading shaft that is located near or on the left of a needlebar so as to be vertically movable and pivotable. The threading shaft has a lower end provided with a threading hook and first and second thread guide members both holding a needle thread. The needle threader further comprises a pivot mechanism pivotally moving the threading hook horizontally and a lifting mechanism moving the threading shaft vertically upon operation of an operation lever by the user.

The threading shaft and accordingly the threading hook and the thread guide members are movable vertically between a standby position that is an uppermost position and a threading position that is a lowermost position where the threading hook is level with an eye of a sewing needle. The threading shaft is usually urged to the standby position (upward) by a spring or the like. In the sewing machine, the needlebar is stopped at a predetermined upward position (needle upper position) relative to the sewing machine head. The aforesaid standby position of the needle threader is set at a predetermined height suitable for execution of the setting of a needle thread (just on the left of a needle clamp).

When a threading operation is carried out using the above-described needle threader, the user firstly sets a needle thread with the threading shaft assuming the standby position as a preliminary work. In the setting work, the needle thread drawn out of a needle thread supply (a thread spool) is passed through a thread tension guide and a needle thread take-up and is then caught on a needlebar thread guide, thereafter being held by the first and second thread guides. In this state, when the user moves down an operation lever mounted on a side of the head of the machine body, the threading shaft and the like are moved downward relative to the needlebar, reaching the threading position. When the operation lever is further moved downward, the threading hook is pivotally moved at the threading position by the pivot mechanism, so that the needle thread is caused to pass through the eye of the needle. The needle thread held by the thread guide members is hooked thereby to be seized. Next, when the user releases the operation lever from the downward force, the threading hook is pivotally moved in the opposite direction thereby to be pulled back through the eye of the needle, whereby the needle thread seized by the threading hook passes through the eye of the needle. Thereafter, the threading shaft and the like are returned to the standing position.

In the above-described conventional sewing machine, the threading shaft is stopped at a predetermined height position (the standby position) near the needlebar (the left side) during the sewing operation. However, the threading hook and the thread guide members are located near the needle when the threading shaft is located at the standby position. Accordingly, the threading hook and the thread guide members block the user's view when the user views a needle base portion including the needle and the periphery thereof, thereby reducing the visibility.

SUMMARY

Therefore, an object of the present disclosure is to provide a needle threader for a sewing machine, which can reliably cause the needle thread to pass through the eye of the needle by the user's easy operation and effectively prevent the threading mechanism from reducing the user's visibility when the user views the needle base portion.

The present disclosure provides a needle threader for a sewing machine, which is provided on a head of a sewing machine body for threading a needle by causing a needle thread from a needle thread supply to pass through an eye of a needle mounted on a lower end of a needlebar supported on a needlebar frame with a needle clamp being interposed therebetween, the needle threader comprising a threading shaft which is mounted on the needlebar frame so as to be vertically movable; a threading mechanism including a threading hook provided on a lower end of the threading shaft and a thread guide member, the threading hook and the thread guide member being movable among a thread guide preparation position where the threading hook and the thread guide member are located near a height position of the needle clamp, a threading operation position where a threading operation is carried out with the threading hook being level with the eye of the needle, and a retreat position which is located above the thread guide preparation position and to which the threading hook and the thread guide member are retreated; a vertical moving mechanism which moves the threading shaft vertically so that the threading mechanism is moved between the thread guide preparation position and the threading operation position; a pivot mechanism which pivotally moves the threading hook when the threading mechanism is moved down to the threading operation position, so that the threading hook passes through the eye of the needle, the pivot mechanism pivotally moving the threading hook after the needle thread held by the thread guide member has been hooked by the threading hook, so that the threading hook is returned; and a position changeover unit which displaces the threading mechanism among the thread guide preparation position, the threading operation position and the retreat position.

According to the above-described construction, a preparation operation to hold the needle thread on the thread guide member by the user can easily be carried out at the thread guide preparation position located near the height position of the needle clamp. Accordingly, the needle thread can reliably be caused to pass through the eye of the needle by a simple operation by the user. Furthermore, the threading mechanism is movable from the thread guide preparation position further to the upper retreat position and the position changeover unit displaces the threading mechanism among the thread guide preparation position, the threading operation position and the retreat position. Consequently, when the threading mechanism is moved to the retreat position by the position changeover unit, the threading mechanism can effectively be prevented from blocking the user's visibility when the user views the needle base portion.

The disclosure also provides a needle threader for a sewing machine, which is provided on a head of a sewing machine body for threading a needle by causing a needle thread from a needle thread supply to pass through an eye of a needle mounted on a lower end of a needlebar supported on a needlebar frame with a needle clamp being interposed therebetween, the needle threader comprising a threading shaft which is mounted on the needlebar frame so as to be vertically movable; a needle threading mechanism including a threading hook provided on a lower end of the threading shaft and a thread guide member, the threading hook and the thread guide member being movable among a thread guide preparation position where the threading hook and the thread guide member are located near a height position of the needle clamp, a threading operation position where a threading operation is carried out with the threading hook being level with the eye of the needle, and a retreat position which is located above the thread guide preparation position and to which the threading hook and the thread guide member are retreated; a vertical moving mechanism which moves the threading shaft vertically so that the threading mechanism is moved between the thread guide preparation position and the threading operation position; a pivot mechanism which pivotally moves the threading hook when the threading mechanism is moved down to the threading operation position, so that the threading hook passes through the eye of the needle, the pivot mechanism pivotally moving the threading hook after the needle thread held by the thread guide member has been hooked by the threading hook, so that the threading hook is returned; and an automatic position changeover unit which includes an actuator and a drive mechanism and displaces the threading mechanism among the thread guide preparation position, the threading operation position and the retreat position.

According to the above-described construction, too, a preparation operation to hold the needle thread on the thread guide member by the user can easily be carried out at the thread guide preparation position located near the height position of the needle clamp. Accordingly, the needle thread can reliably be caused to pass through the eye of the needle by a simple operation by the user. Furthermore, the threading mechanism is movable from the thread guide preparation position further to the upper retreat position and the position changeover unit displaces the threading mechanism among the thread guide preparation position, the threading operation position and the retreat position. Consequently, when the threading mechanism is moved to the retreat position by the position changeover unit, the threading mechanism can effectively be prevented from blocking the user's visibility when the user views the needle base portion. Moreover, the user can save his or her time since the threading mechanism is automatically displaced among the thread guide preparation position, the threading operation position and the retreat position.

In the above-described construction, the drive mechanism includes a pinion which is rotatably supported on a moving member moved vertically by the actuator, a fixed rack which is fixedly mounted on the sewing machine body so as to extend vertically and with which the pinion is brought into mesh engagement, and a movable rack which is located opposite the fixed rack with the pinion being interposed therebetween. The movable rack is vertically movable so as to be brought into mesh engagement with the pinion. A larger stroke can be given to the vertical movement of the threading shaft (the threading mechanism) while the drive mechanism can be compacted.

The needle threader further comprises an operation switch which instructs positional changeover of the threading mechanism between the thread guide preparation position and the retreat position. In this case, the actuator of the position changeover unit is driven based on operation of the operation switch. Consequently, the threading hook and the thread guide member can be moved to either the thread guide preparation position or the retreat position at any time.

The needle threader further comprises a detecting unit which detects whether or not a needle threading operation needs to be executed. In this case, the threading mechanism is normally located at the retreat position by the automatic position changeover unit. When the detecting unit detects that a needle threading operation needs to be executed, the threading mechanism is moved to the thread guide preparation position by the automatic position changeover unit. The threading mechanism can automatically be moved to the thread guide preparation position without instruction by the user when the threading operation needs to be executed. Consequently, the usability of the needle threader can be improved.

The needle threader further comprises a mode setting unit which sets a mode in which the retreat position or the thread guide preparation position is set as a stop position of the threading mechanism. Consequently, the user can use the two modes having different stop positions of the threading mechanism under normal conditions as the situation demands. In this construction, the sewing machine body may be provided with a stitch pattern selecting unit which selects one of a plurality of stitch patterns to be sewn. In this case, the mode setting unit is designed to automatically set the mode according to a type of the stitch pattern selected by the stitch pattern selecting unit. Consequently, the usability of the needle threader can be improved.

The disclosure further provides a needle threader for a sewing machine, which is provided on a head of a sewing machine body for threading a needle by causing a needle thread from a needle thread supply to pass through an eye of a needle mounted on a lower end of a needlebar supported on a needlebar frame with a needle clamp being interposed therebetween, the needle threader comprising a threading shaft which is mounted on the needlebar frame so as to be vertically movable; a threading mechanism including a threading hook provided on a lower end of the threading shaft and a thread guide member, the threading hook and the thread guide member being movable among a thread guide preparation position where the threading hook and the thread guide member are located near a height position of the needle clamp, a threading operation position where a threading operation is carried out with the threading hook being level with the eye of the needle, and a retreat position which is located above the threading preparation position and to which the threading hook and the thread guide member are retreated; a vertical moving mechanism which moves the threading shaft vertically so that the threading mechanism is moved between the thread guide preparation position and the threading operation position; a pivot mechanism which pivotally moves the threading hook when the threading mechanism is moved downward to the threading operation position, so that the threading hook passes through the eye of the needle, the pivot mechanism pivotally moving the threading hook after the needle thread held by the thread guide member has been hooked by the threading hook, so that the threading hook is returned; and a position-changeover operation unit which is manually operated so that the threading mechanism is displaced among the thread guide preparation position, the threading operation position and the retreat position.

According to the above-described construction, a preparation operation to hold the needle thread on the thread guide member by the user can easily be carried out at the thread guide preparation position located near the height position of the needle clamp. Accordingly, the needle thread can reliably be caused to pass through the eye of the needle by a simple operation by the user. Furthermore, the threading mechanism is movable from the thread guide preparation position further to the upper retreat position and the position changeover unit displaces the threading mechanism among the thread guide preparation position, the threading operation position and the retreat position. Consequently, when the threading mechanism is moved to the retreat position by the position changeover unit, the threading mechanism can effectively be prevented from blocking the user's visibility when the user views the needle base portion. In this case, the threading mechanism can be moved to a desired one of the thread guide preparation position and the retreat position when the user operates the position changeover unit.

In the above-described construction, the position changeover unit includes a threading lever moving the threading shaft vertically, a slider which is manually moved vertically thereby to move the threading lever vertically, and a locking mechanism which stops the slider at a first position corresponding to the retreat position and a second position corresponding to the thread guide preparation position. Consequently, since the slider can be stopped at the first and second positions by the locking mechanism, the threading lever and accordingly the threading mechanism can be retained in a stopped state at the threading preparation and retreat positions.

The locking mechanism includes an engagement protrusion engageable with the slider and a cam plate having a grooved cam which extends in an up-and-down direction and which the engagement protrusion engages thereby to be guided. In this case, the grooved cam has an upper end provided with a first locking portion which locks the engagement protrusion thereby to stop the slider at the first position, an intermediate part provided with a second locking portion which locks the engagement protrusion thereby to stop the slider at the second position, and a lower end provided with a threading position which lowers the slider to a third position corresponding to the threading operation position. The engagement protrusion provided on the slider is engaged with the grooved cam to be guided, whereupon the slider can smoothly be moved vertically. Furthermore, since the grooved cam is provided with the first and second locking portions, the slider can reliably be retained in the stopped state at the first and second positions.

The grooved cam of the cam plate has a first path which guides the engagement protrusion so that the engagement protrusion is moved from the first locking portion to the second locking portion and further moved down to the threading position and a second path which guides the engagement protrusion so that the engagement protrusion is returned from the threading position to the first locking portion without passing the second locking portion. When the slider is moved downward from the first position to the second position and further to the third position, the engagement protrusion is moved along the first path of the cam groove. When the slider is moved upward from the third position to the first position, the engagement protrusion is moved along the second path differing from the first path. Consequently, since the slider need not be stopped at the second position when returned from the third position to the first position, an efficient operation can be carried out.

Furthermore, when the slider is operated so as to be moved downward to a cancel position between the second and the third positions while the engagement protrusion is locked by the second locking portion such that the slider is stopped at the second position, the engagement protrusion is moved from the first path to the second path and is then returned to the first locking portion, whereby the slider is returned to the first position. When the threading operation should be canceled after the threading mechanism has been moved to the thread guide preparation position, the slider occupying the second position is moved downward to the cancel position. Consequently, the slider can easily be returned to the first position and the threading mechanism can be moved to the retreat position.

The needle threader further comprises a reset unit which releases the engagement protrusion from engagement with a cam groove. The slider can freely be moved when the engagement protrusion is released from the engagement with the cam groove. Consequently, for example, when the slider is to be forced to return to the first position, this can easily be coped with.

The needle threader further comprises a threading lever which moves the threading shaft vertically and an automatic position changeover unit which automatically displaces the threading mechanism among the thread guide preparation position, the threading operation position and the retreat position. The threading mechanism can automatically be moved among the thread guide preparation position, the threading operation position and the retreat position by the automatic position changeover unit. Consequently, the user can save his or her time and accordingly, the usability of the needle threader can be improved.

BRIEF DESCRIPTION OF THE DRAWINGS

Other objects, features and advantages of the present disclosure will become clear upon reviewing the following description of the embodiment with reference to the accompanying drawings, in which:

FIG. 8 shows a flow of threading operation in a first mode;

FIG. 10 shows a flow of threading operation in a second mode differing from the first mode in FIG. 8;

DETAILED DESCRIPTION OF EMBODIMENTS

Figure 1:
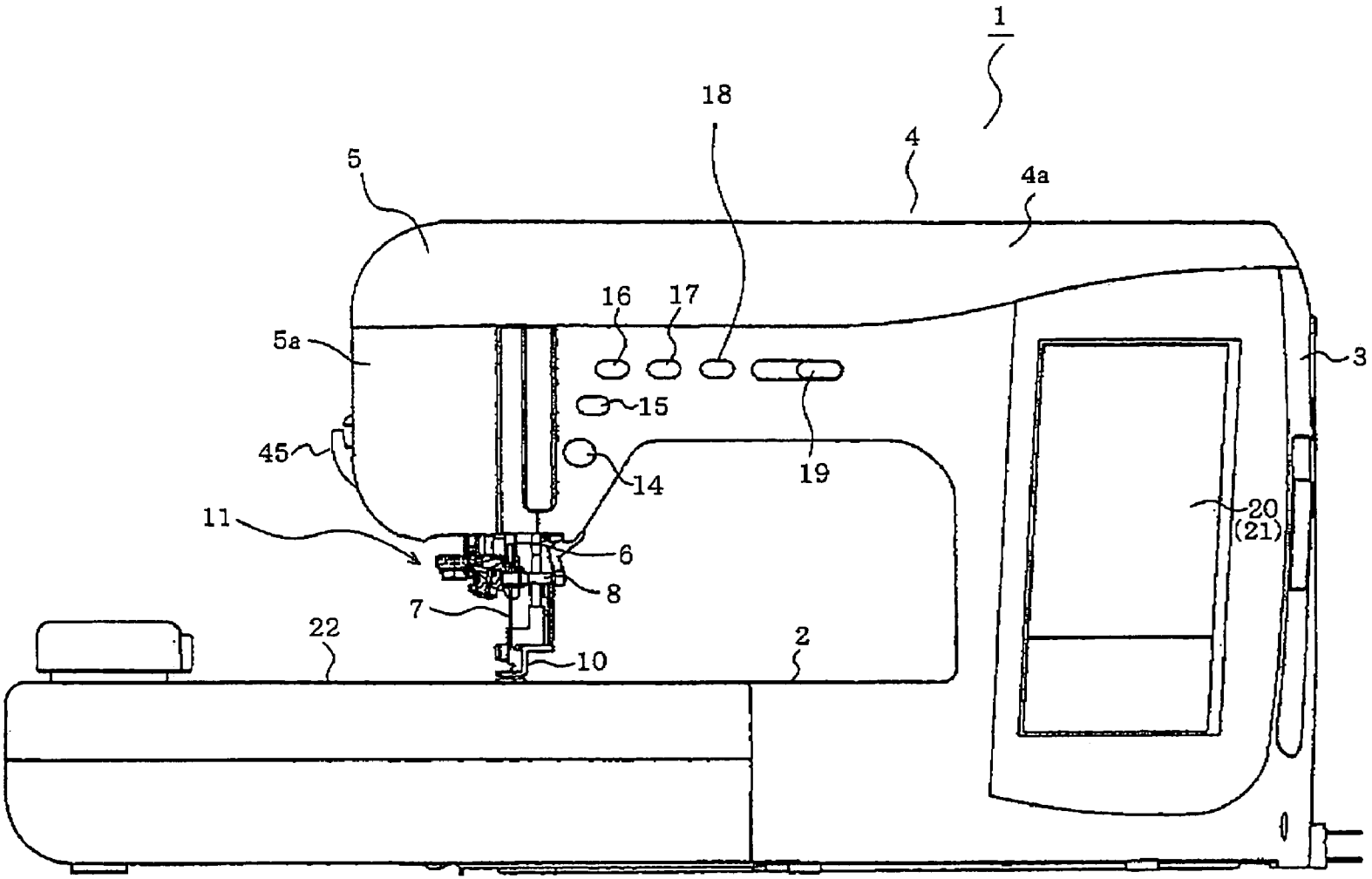
FIG. 1 is a front view of a sewing machine body to which a needle threader of a first example in accordance with the disclosure is applied.

A first embodiment will now be described with reference to FIGS. 1 to 8. Referring to FIG. 1, a household electronic sewing machine to which a needle threader of the embodiment is applied is shown. A sewing machine body 1 includes a sewing machine bed 2 extending in a horizontal direction (the X direction), a pillar 3 extending upward from a right end of the bed 2, and an arm 4 extending leftward from an upper end of the pillar 3, all of which are formed integrally with the body 1. The arm 4 has a distal end serving as a head 5. Furthermore, a cover 4*a* is mounted on an upper part of the arm 4 so as to be closed and opened. A thread spool accommodating space is defined in a space inside the cover 4*a* in the arm 4 although not shown. A needle thread spool serving as a needle thread supply is adapted to be detachably set into the thread spool accommodating space. The needle thread spool can be attached and detached (replaced) when the cover 4*a* is opened.

Figure 2A:
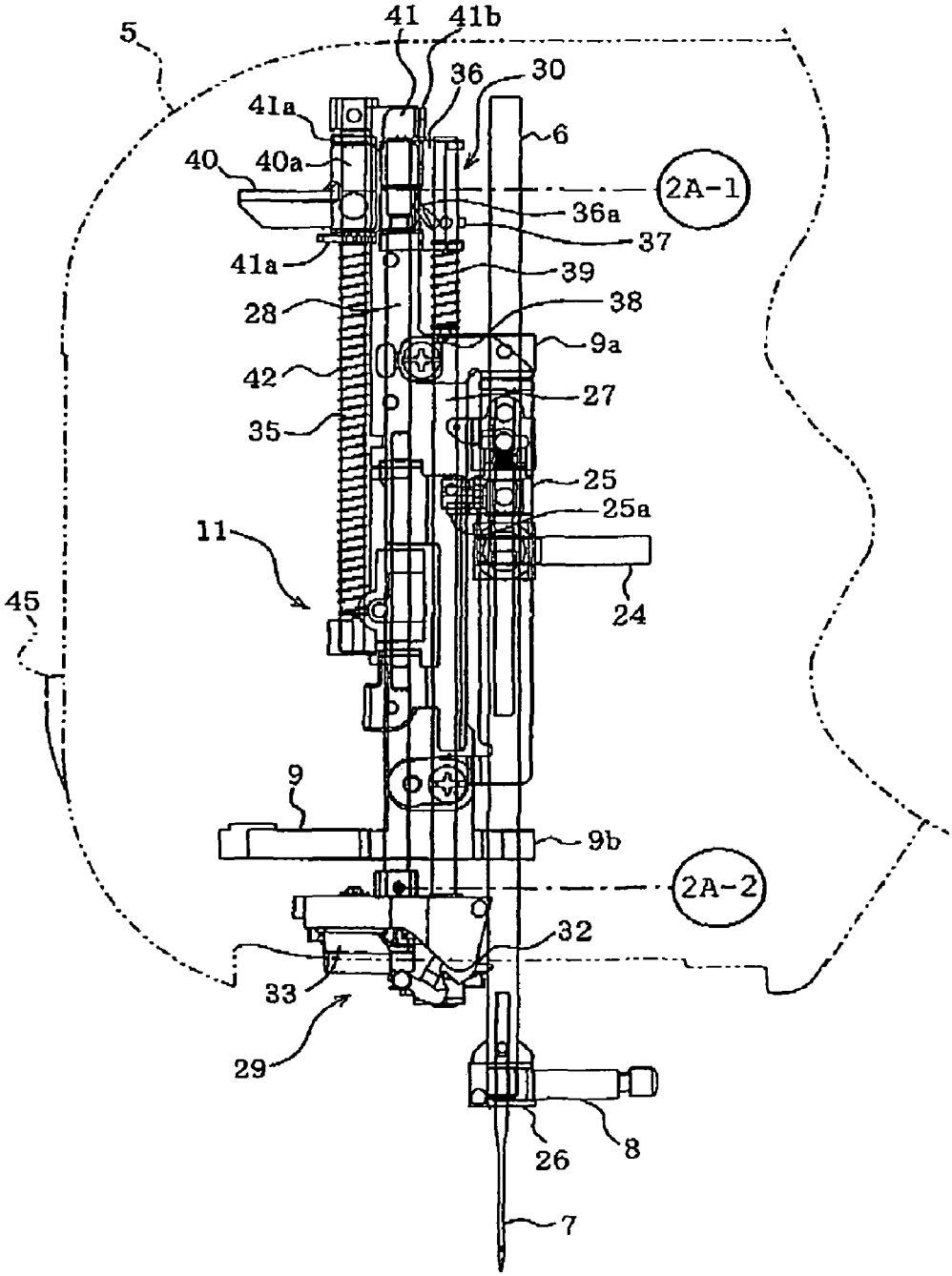
FIGS. 2A, 2B and 2C are longitudinal sectional front views of the needle threader in the case where a threading mechanism is located at a retreat position, a thread guide preparation position and a threading operation position respectively.
Figure 2B:
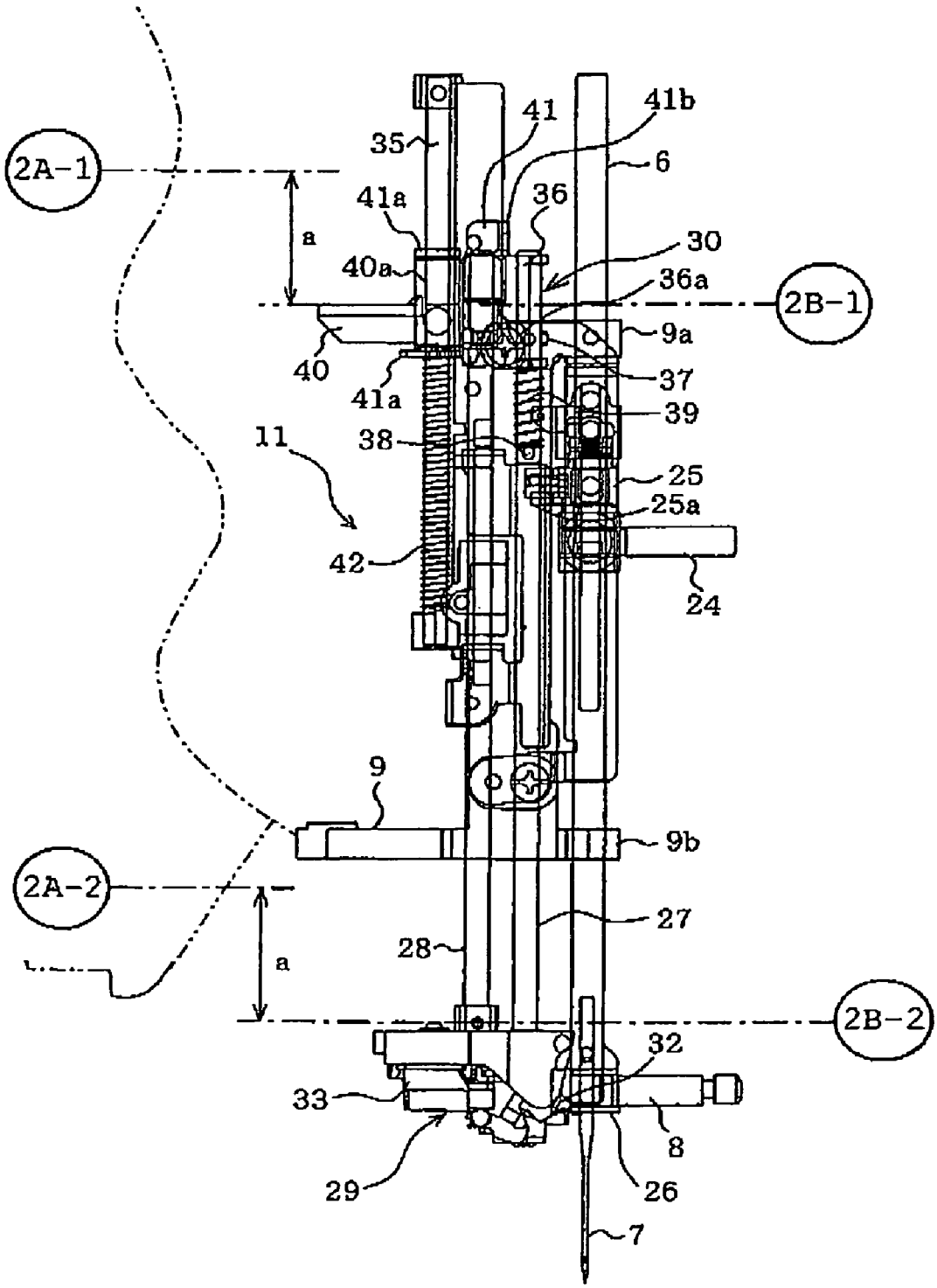
Figure 2C:
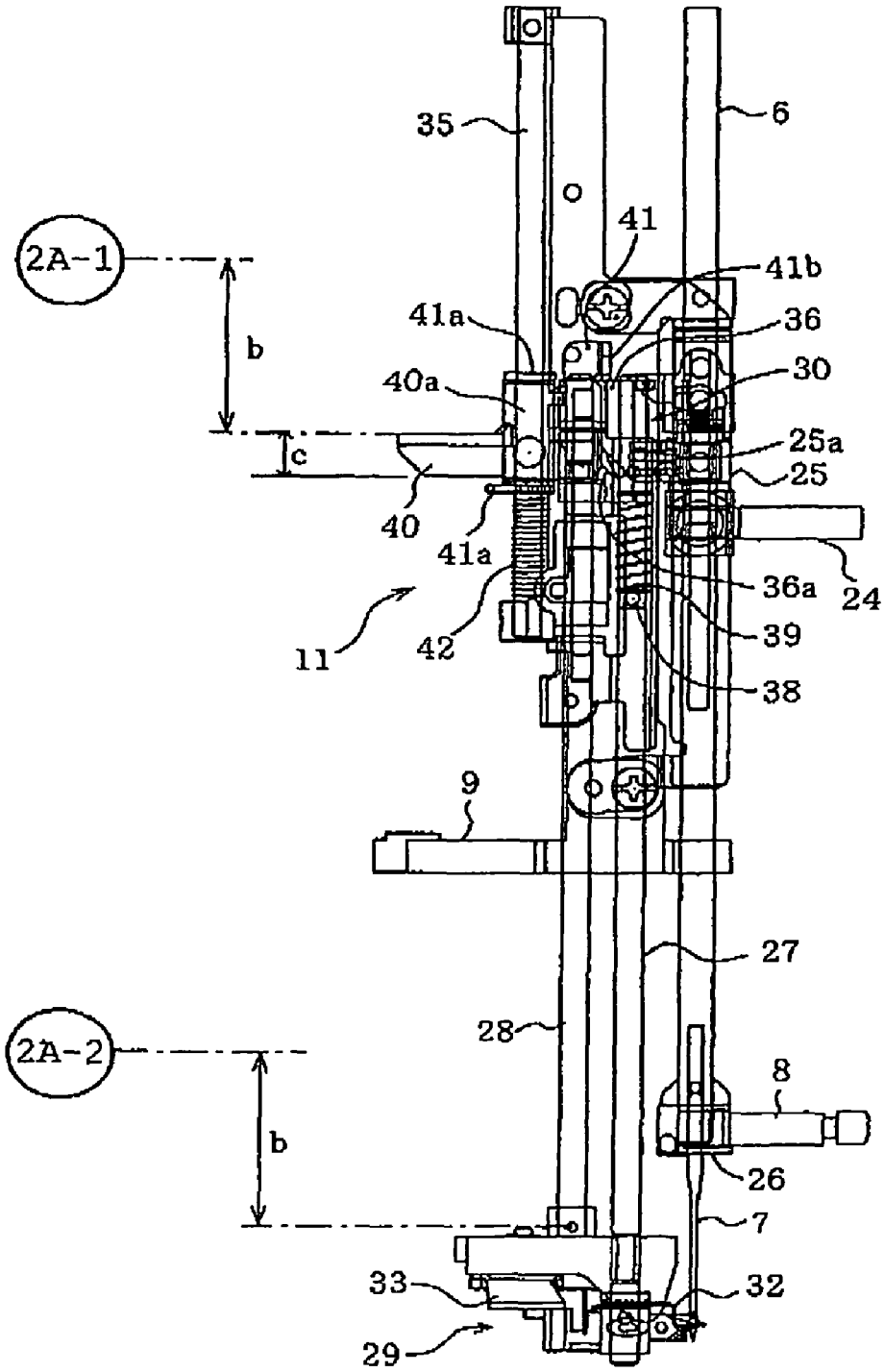

A needlebar 6 is mounted on the head 5 and has a lower end to which a sewing machine needle 7 is attached with a needle clamp 8 being interposed therebetween as also shown in FIGS. 2A to 2C. A needlebar frame 9 is mounted in the head 5 so as to be swingable in the horizontal direction (the X direction) relative to a sewing machine frame as shown in FIG. 2A. The needlebar 6 is supported on the needlebar frame 9 so as to be vertically movable. A presser foot 10 is mounted on the head 5 so as to be located below the needlebar 6 (the needle 7) as shown in FIG. 1. Furthermore, the needle threader 11 of the embodiment is provided on the left of the needlebar 6 (the needle 7) for threading the needle 7 by causing a needle thread T (see FIGS. 5A, 5B, 6A and 6B) from the needle thread spool to pass through an eye 7*a* (see FIGS. 6A and 6B) of the needle 7. The needle threader 11 will be described in detail later.

A sewing machine main shaft is provided in the arm 4 so as to be rotated by a sewing machine motor 12 (see FIG. 7) although not shown. A drive force of the main shaft is transmitted to a needlebar drive mechanism, which moves the needlebar 6 vertically. A needlebar swing mechanism is driven by a needle swing pulse motor 13 (see FIG. 7) serving as a drive source to swing the needlebar frame 9 and accordingly the needlebar 6 in a direction perpendicular to a cloth feed direction (the X direction). Furthermore, a needle thread take-up drive mechanism is provided in the arm 4 for moving a needle thread take-up (not shown) in synchronization with the vertical movement of the needlebar 6. A thread tension adjusting device is further provided in the arm 4 for adjusting a tension of the needle thread T. A face plate 5*a* serves as an exterior cover member which covers a side surface of the head 5. A thread cutter 45 is mounted on the face plate 5*a* and will be described later.

A start/stop key 14 is provided on the front side of the arm 4 as shown in FIG. 1. The start/stop key 14 is operated so that start and stop of a sewing operation is instructed. On the front side of the arm 4 are further provided various operation keys (switches) including a backstitching key 15, a needle-up/-down key 10, a thread cut key 17, a threading key 18 serving as an operation switch and a speed adjusting knob 19. A large-size full-color liquid-crystal display 20 is mounted on the front of the pillar 3. The liquid-crystal display 20 has a vertically long shape.

A touch panel 21 (see FIG. 7) is mounted on the surface of the liquid-crystal display 20. The display 20 is arranged to display various stitch patterns, names of various functions to be executed, various messages and the like. The stitch patterns include ordinary patterns which form stitches such as a straight stitch, zigzag stitch and the like while workpiece cloth is moved by a feed dog. The stitch patterns further include various embroidery patterns with which embroidery is formed using an embroidering machine 22. In this case, various input operation keys are operated on the touch panel 21. Accordingly, the liquid-crystal display 20 and the touch panel 21 serve as a stitch pattern selecting unit which selects a stitch pattern.

A needle plate (not shown) is provided on an upper surface of the sewing machine bed 2. In the sewing machine bed 2 are provided a feed dog drive mechanism which drives the feed dog in synchronization with the vertical movement of the needlebar 6, a full rotary hook which accommodates a bobbin and forms stitches in cooperation with the needle 7, a thread cutting mechanism and the like although not shown. Furthermore, the embroidering machine (embroidery frame moving device) 22 is detachably attached to a left end of the sewing machine bed 2.

An embroidery frame holding workpiece cloth is attached to the embroidering machine 22 although not shown. The embroidering machine 22 moves the embroidery frame on the sewing machine bed 2 (needle plate) in the X direction (horizontal direction) and the Y direction (front-back direction) perpendicular to the X direction. When the embroidering machine 22 is attached to the sewing machine bed 2, the embroidering machine 22 is electrically connected via a connector 23 (shown only in FIG. 7) to a control device 62 (a control unit) as will be described later. In this case, an embroidering mode is automatically set, instead of the ordinary stitch mode.

The needle threader 11 and its periphery will now be described with further reference to FIGS. 2A to 7 as well as FIG. 1. The needlebar frame 9 extends vertically and includes two support strips 9*a* and 9*b* which are disposed on upper and lower portions thereof respectively so as to project rightward as shown in FIGS. 2A to 2C. The needlebar 6 is inserted through holes (not shown) formed through the support strips 9*a* and 9*b* respectively thereby to be supported by the support strips. The needlebar 6 is connected at its portion located between the support strips 9*a* and 9*b* to the aforesaid needlebar drive mechanism with a needlebar connecting bracket 24 being interposed therebetween. As a result, the needlebar 6 is moved vertically with a predetermined stroke by a needlebar drive mechanism. In this case, the needlebar 6 is stopped at a predetermined upper position (a needle-up position) during stop of the sewing operation (the sewing machine motor 12) as shown in FIGS. 2A to 2C. Furthermore, a positioning member 25 is mounted on the needlebar 6 so as to be located just above the needlebar connecting bracket 24. The positioning member 25 has a protrusion 25*a* protruding leftward. A needlebar thread guide 26 is provided on a lower end of the needlebar 6.

The needle threader 11 is built into the needlebar frame 9 so as to be located on the left of the needlebar 6 as viewed in FIGS. 2A to 2C. The needle threader 11 comprises first and second threading shafts 27 and 28, a threading mechanism 29 provided on lower ends of the threading shafts 27 and 28, and a pivot mechanism 30 that pivotally moves the first threading shaft 27. The threading mechanism 29 includes a threading hook 31 (see FIGS. 6A and 6B) mounted on a lower end of the first threading shaft 27 and a thread holding member 33 mounted on a lower end of the second threading shaft 28. Furthermore, a vertical moving mechanism 34 (see FIGS. 3A and 3B) is located at the rear of the needlebar frame 9 in the head 5. The first and second threading shafts 27 and 28 are automatically moved vertically by the vertical moving mechanism 34. In the embodiment, the vertical moving mechanism 34 automatically moves the threading mechanism 29 among a thread guide preparation position, a threading operation position and a threading operation position as will be described in detail later. With this, the vertical moving mechanism 34 also serves as an automatic position changeover unit (a position changeover unit) which automatically displaces the threading mechanism 29 among the thread guide preparation position, the threading operation position and the retreat position.

The first threading shaft 27 extends vertically just on the left side of the needlebar 6 and is supported on the needlebar frame 9 so as to be vertically movable and pivotable, as shown in FIGS. 2A to 2C. The second threading shaft 28 is located just on the left of the first threading shaft 27 and supported on the needlebar frame 9 so as to be vertically movable. The second threading shaft 28 is normally urged upward (toward the retreat position) relative to the needlebar frame 9. The first and second threading shafts 27 and 28 are adapted to be vertically moved together while upper ends of the shafts are level with each other. Furthermore, a guide shaft 35 extends vertically just on the left of the second threading shaft 28 and is fixedly mounted on the needlebar frame 9. The guide shaft 35 guides a threading lever 40 which will be described later.

A threading slider 36 is inserted through holes (not shown) of the upper ends of the first and second threading shafts 27 and 28 so as to straddle both shafts and so as to be vertically movable. The threading slider 36 has a semi-cylindrical wall surrounding a left half of an upper part of the first threading shaft 27. The wall is formed with a cam groove 36*a* extending obliquely. On the other hand, a sliding pin 37 is provided so as to extend horizontally through a hole (not shown) of an upper part of the first threading shaft 27. The sliding pin 37 is inserted through the cam groove 36*a*, whereby a pivot mechanism 30 is constituted. A spring receiving pin 38 is provided on the first threading shaft 27 so as to be located slightly below the sliding pin 37. A coil spring 39 is provided between the spring receiving pin 38 and a lower end of the threading slider 36.

Figure 3A:
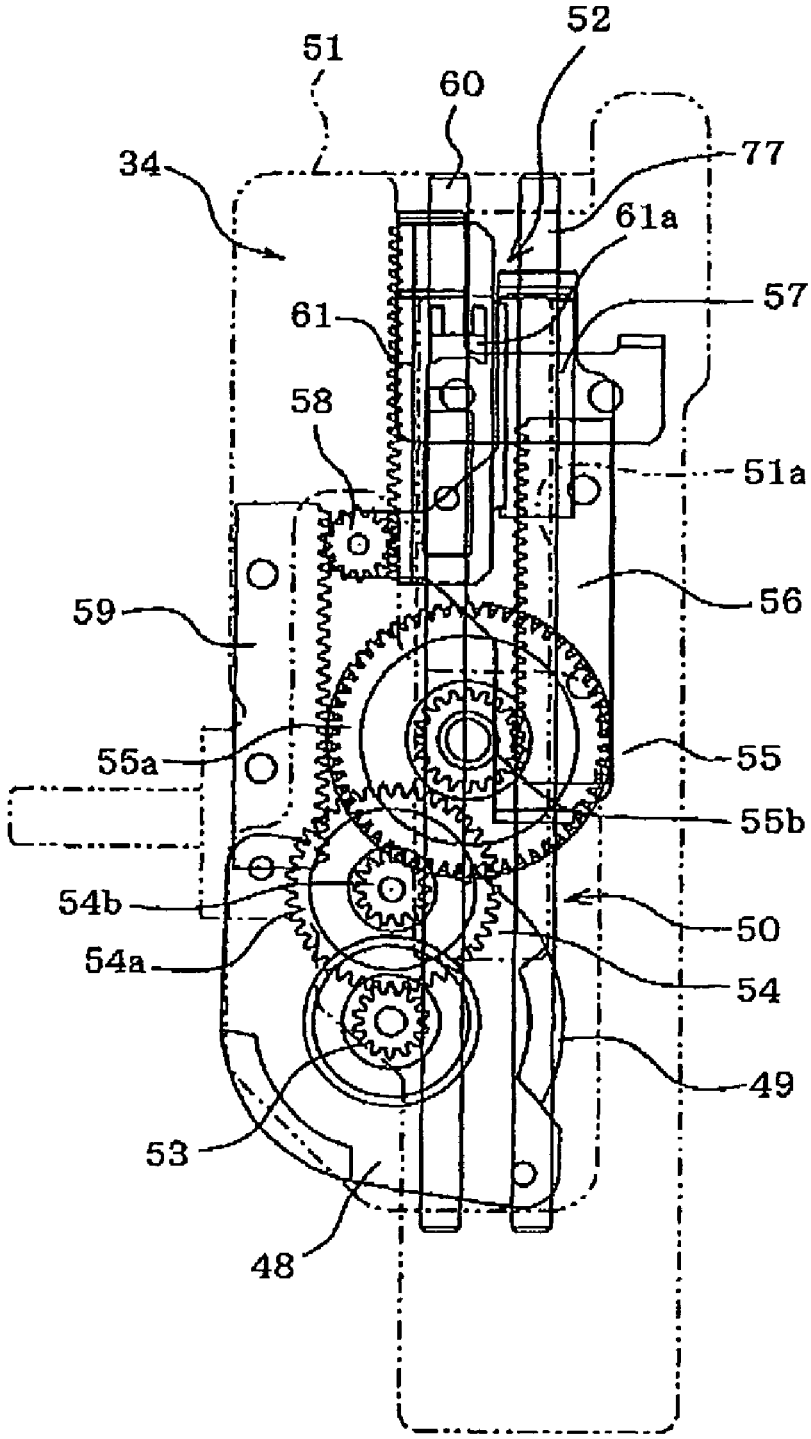
FIGS. 3A and 3B are longitudinal sectional front and left side views of a vertical moving mechanism respectively.
Figure 3B:
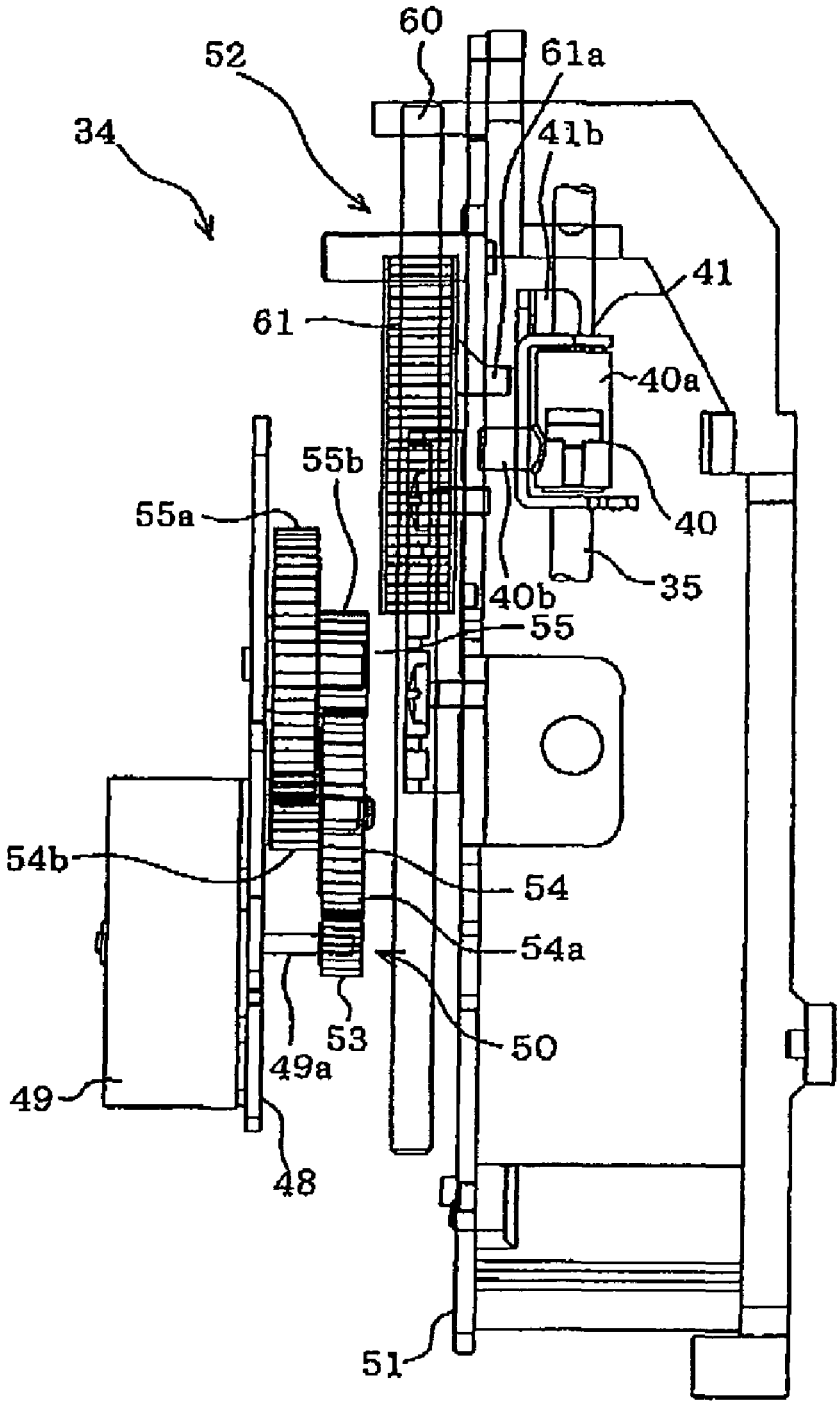

A threading lever 40 vertically moving the threading shafts 27 and 28 and a lever plate 41 are fitted in the guide shaft 35 so as to be vertically movable. The threading lever 40 has an integrally formed cylindrical portion 40*a* extending leftward to be inserted into the guide shaft 35 as viewed in FIG. 3B. The cylindrical portion 40*a* is provided with a protrusion 40*b* that protrudes toward the rear only as shown in FIG. 3B. The protrusion 40*b* is vertically driven by the vertical moving mechanism 34. The lever 41 has two sliding rings 41*a* which are fitted in the guide shaft 35 so as to be vertically movable. The sliding rings 41*a* are disposed so that the cylindrical portion 40*a* is vertically interposed therebetween. Furthermore, the lever plate 41 includes a plate portion and an operating strip 41*a* both formed integrally therewith. The plate portion extends rightward from the sliding rings 41*a*. The operating strip 41*b* is located at an upper end of the plate portion so as to be in contact with an upper surface of the threading slider 36, thereby pressing the threading slider down. A compression coil spring 42 is provided on the guide shaft 35 to normally urge the threading lever 40 and the lever plate 41 upward. As the result, the threading lever 40 and the lever plate 41 are located at the upper end of the guide shaft 35 by the spring force of the compression coil spring 42 when the threading lever 40 is not subjected to a downwardly depressing force, as shown in FIG. 2A. In this state, the threading slider 36 and the threading shafts 27 and 28 are located at the respective highest positions relative to the needlebar frame 9. These positions correspond to a retreat position where the threading mechanism 29 provided on the lower end of the threading shafts 27 and 28 is retreated upward thereby to be accommodated in the face plate 5*a* of the head 5.

The threading lever 40 and accordingly the threading shafts 27 and 28, the threading mechanism 29 and the like are moved downward by distance a, thereby assuming a thread guide preparation position as shown in FIG. 2B. At the thread guide preparation position, the threading mechanism 29 is located near a height position of the needle clamp 8 of the needlebar 6 assuming the needle-up position. The user then carries out a preparatory work for threading the needle 7 at the thread guide preparation position as will be described later. When the threading lever 40 and the like are further moved by distance b downward from the thread guide preparation position as shown in FIG. 2B, the sliding pin 37 of the first threading shaft 27 engages the protrusion 25*a* of the positioning member 25 of the needlebar 6. As a result, the positioning member 25 limits further downward movement of the first threading shaft 27 relative to the needlebar 6. This position corresponds to a threading operation position as shown in FIG. 2C. At the threading operation position, the threading hook 31 is level with the eye 7*a* of the needle 7, whereupon a threading operation is executable.

In this case, the threading lever 40 is further moved by distance c downward from the threading operation position. As the result of the downward movement of the threading lever 40, the threading slider 36 is also moved downward via the lever plate 41 by distance c relative to the threading shafts 27 and 28 against the spring force of the compression coil spring 39. As a result, the sliding pin 37 of the first threading shaft 27 is relatively moved obliquely upward in the cam groove 36*a* of the threading slider 36. Thus, the first threading shaft 27, the threading hook 31 and the like pivotally moved clockwise by the pivot mechanism 30 so that a threading operation is carried out, as viewed from the top of the sewing machine.

Subsequently, when the threading lever 40 is released from the pressed state, the threading lever 40, the spring force of the compression coil spring 39 firstly moves the threading hook 31 and the like upward by distance c relative to the threading shafts 27 and 28. In this case, since the sliding pin 37 is relatively moved downward in the cam groove 36*a* of the threading slider 36, the first threading shaft 27 and the threading hook 31 are pivotally moved backward. Thereafter, the threading lever 40 is moved upward by distance (b+c), whereupon the threading shafts 27 and 28 and the threading mechanism 29 are also moved upward thereby to be returned to the retreat position as shown in FIG. 2A.

Figure 5A:
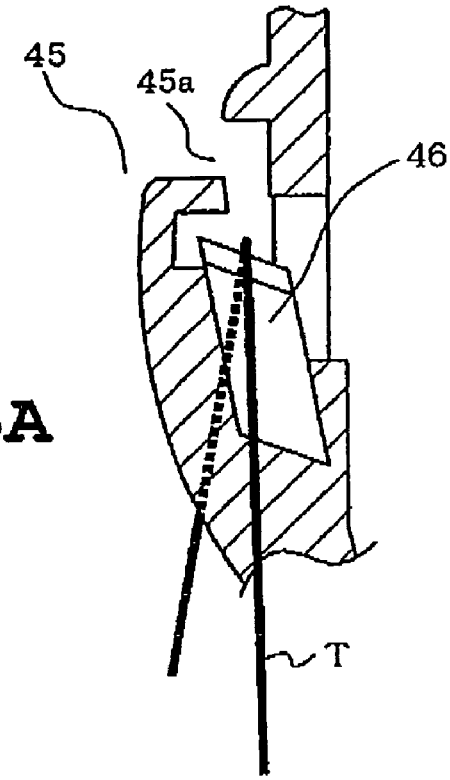
FIGS. 5A and 5B are longitudinal sectional front views of a thread cutter and a modified thread cutter respectively.
Figure 6A:
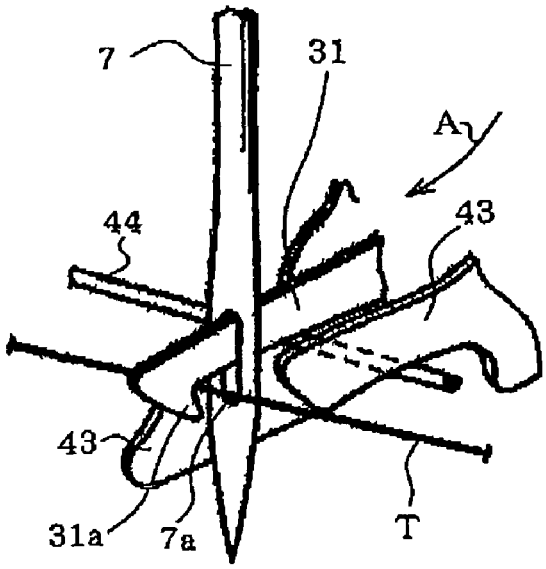
FIG. 6 is an enlarged perspective view of a threading hook, showing an operation of the threading hook during the threading operation.
Figure 6B:
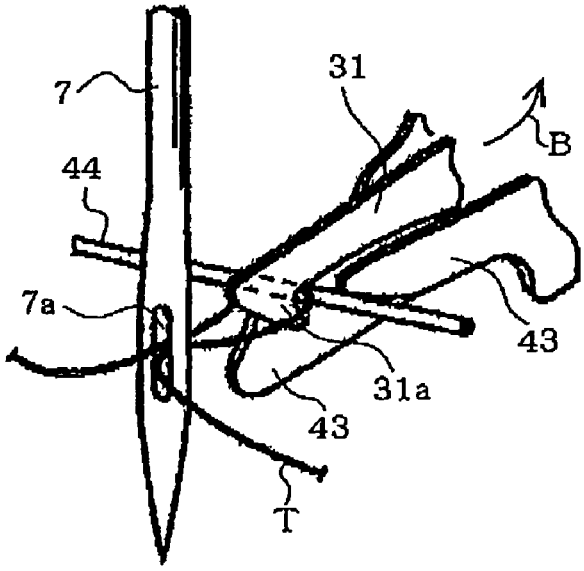

Next, the threading mechanism 29 provided on the lower ends of the threading shafts 27 and 28 will now be described in detail. The threading hook 31 mounted on the lower end of the first threading shaft 27 has a distal end with a downwardly directed hook 31*a* as shown in FIGS. 6A and 6B. The hook 31*a* is insertable through the eye 7*a* of the needle 7. The lower end of the first threading shaft 27 is further provided with a pair of guide members 43 located at both sides of the threading hook 31, and a thread holding wire 44. Furthermore, a thread guide member 32 (see FIGS. 2A to 2C) provided on the lower end of the first threading shaft 27 serves to hold the needle thread T in a horizontal state in front of the eye 7*a* of the needle 7 during the threading operation as shown in FIG. 6A. Furthermore, a thread guide member 33 (see FIGS. 2A to 2C) provided on the lower end of the second threading shaft 28 serves to hold a distal end of the needle thread T with a slight pressure. In this case, a thread cutter 45 is mounted on a left side of the face plate 5*a* of the head 5 as shown in FIGS. 1 and 5A. The thread cutter 45 has a groove 45*a* through which the needle thread T passes and a blade 46 which cuts the needle thread T as shown in FIG. 5A.

Figure 5B:
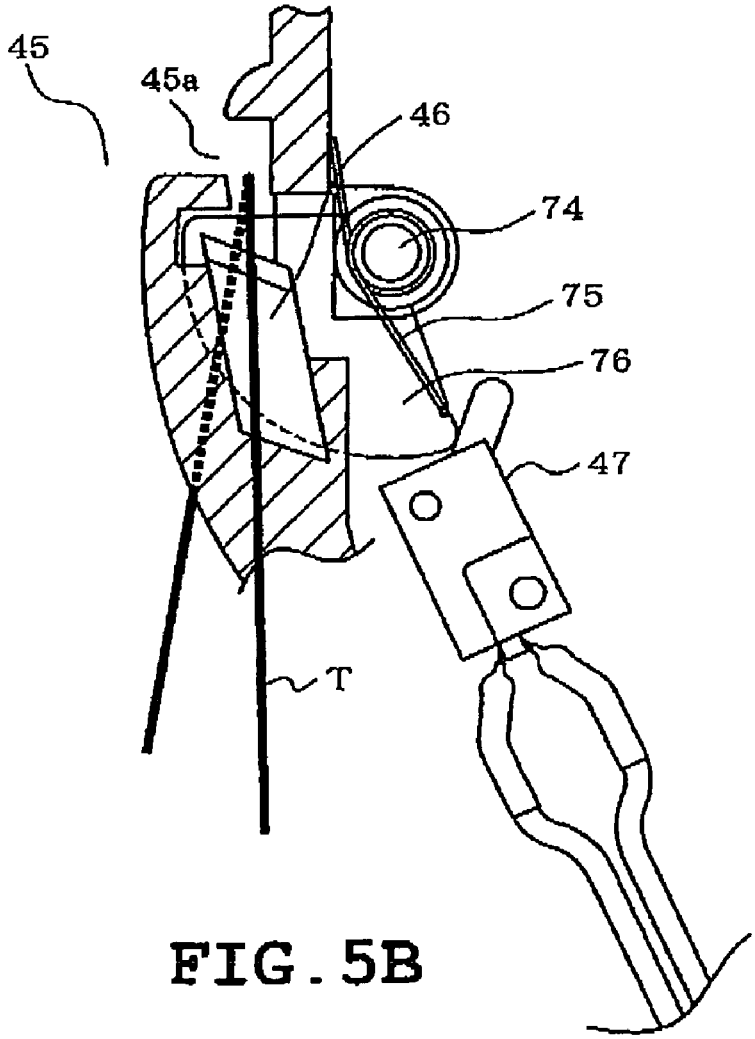

Alternatively, the thread cutter 45 may have a construction as shown in FIG. 5B. More specifically, in addition to the groove 45*a* and the blade 46, the thread cutter 45 includes a swing lever 76 which is pushed downward by the needle thread T when the needle thread T having passed through the groove 45*a* is pulled downward thereby to be cut. The thread cutter 45 further includes a support pin 74 which swingably supports the swing lever 76, a torsion coil spring 75 which is mounted about the support pin 74 to urge the swing lever 76 clockwise with a slight elastic force as viewed in FIG. 5B, and a needle thread cut detecting switch 47 which detects a swing of the swing lever 76. The swing lever 76 is normally held in a position as shown in FIG. 5B. The swing of the swing lever 76 is detected by the aforesaid needle thread cut detecting switch 47. More specifically, the user determines whether the preparation for threading has been completed with the needle thread T having been cut.

In this case, the threading preparation operation is carried out in a following manner. The needle thread T drawn from the needle thread spool has already been passed through a predetermined needle thread path including the thread tension adjusting device and the needle thread take-up. The user then passes the needle thread T through the needlebar thread guide 26 of the needlebar 6. The needle thread T having been passed through the needlebar thread guide 26 is hooked and held by the thread guide member 32 and further held by the thread holding member 33. Subsequently, the needle thread T is caused to pass through the groove 45*a* of the thread cutter 45 so that the distal end thereof is cut and removed. As a result, the needle thread T has been caused to pass through the necessary path and held and cut into an optimum length, whereby the preparation for threading has been completed.

In the aforesaid state, the threading mechanism 29 is moved downward to the threading operation position, and the first threading shaft 27 is pivotally moved so that the threading hook 31 is moved in the direction of arrow A in FIG. 6A thereby to cause the needle thread T to pass through the eye 7*a* of the needle 7. The needle thread T held by the thread guide member 32 is hooked by the hook 31*a*. Subsequently, the first threading shaft 27 is returned in the direction of arrow B in FIG. 6B such that the needle thread T passes through the needle eye 7*a* together with the threading hook 31, whereupon the needle 7 has been threaded. A more detailed construction and operation of the threading mechanism 29 are described in Japanese patent application publication JP A 2006 158412 filed by the assignee of the present application and U.S. Pat. No. 7,281,479 B2 corresponding to the Japanese application, both of which are incorporated herein by reference.

The vertical moving mechanism 34 which vertically moves the threading lever 40 will now be described in detail with reference to FIGS. 3A, 3B and 4A to 4C. The vertical moving mechanism 34 comprises a threading pulse motor 49 serving as an actuator, a gear mechanism (a speed reduction mechanism) 50 and a rack and pinion mechanism 52 provided in front of the pulse motor 49 and the gear mechanism 50. The pulse motor 49 and the gear mechanism 50 are built onto a plate-shaped unit base fixedly mounted in the head 5 thereby to be unitized. The rack and pinion mechanism 52 is built onto an underside of a plate-shaped sub-frame 51 which is fixedly mounted so as to be located in front of the unit base 48. The threading pulse motor 49 is mounted on the underside of the unit base 48 so as to be forward directed and so as to protrude to the surface side as shown in FIGS. 3A and 3B. The motor 49 includes a rotating shaft 49*a* on which a small-diameter gear 53 is mounted. The gear mechanism 50 includes an intermediate gear 54 rotatably mounted on an intermediate part of the surface of the unit base 48 and a drive gear 55 rotatably mounted on an upper part of the intermediate gear 54.

Figure 4A:
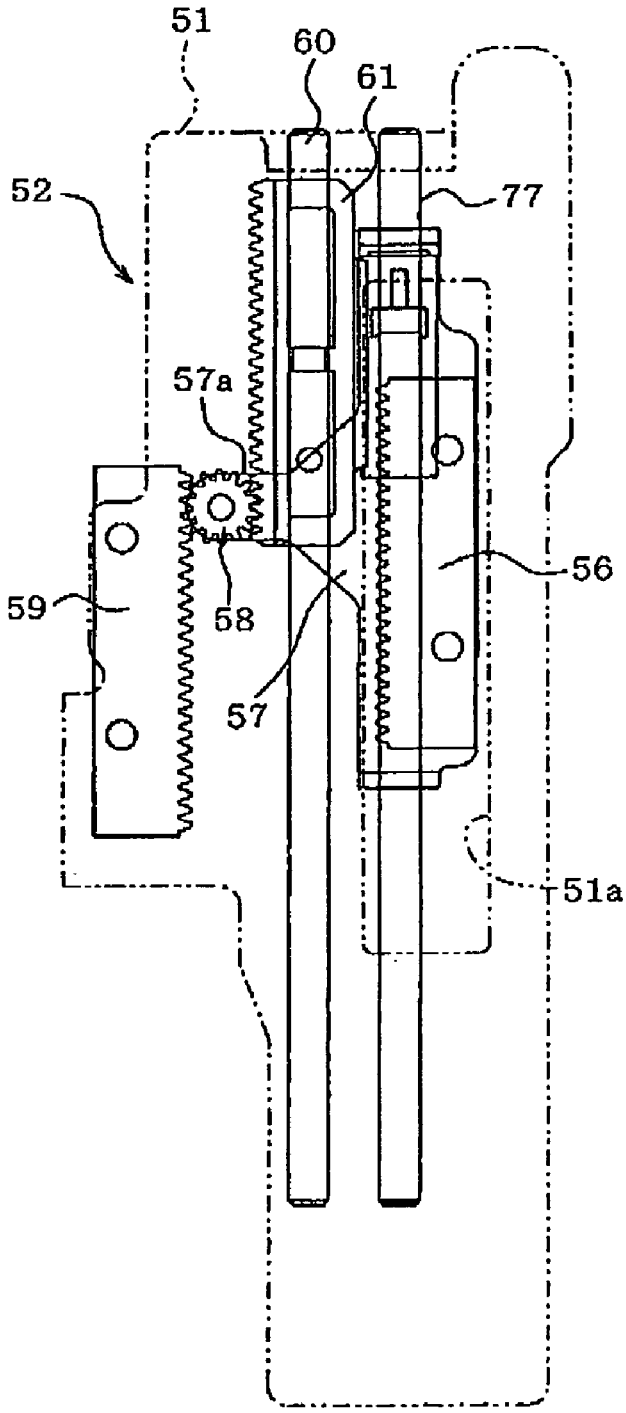
FIGS. 4A, 4B and 4C are longitudinal sectional front views of a rack and pinion mechanism in the case where a movable rack is at a position corresponding to the retreat position, the thread guide preparation position and the threading operation position respectively.
Figure 4B:
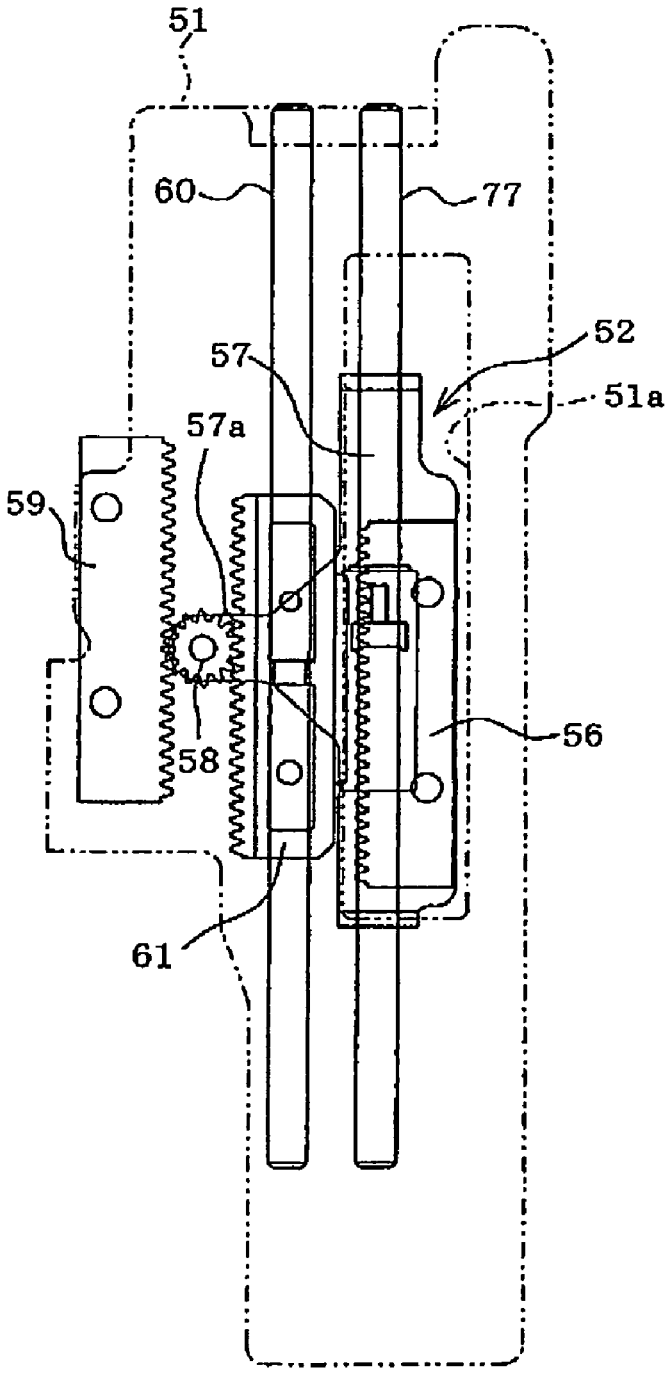
Figure 4C:
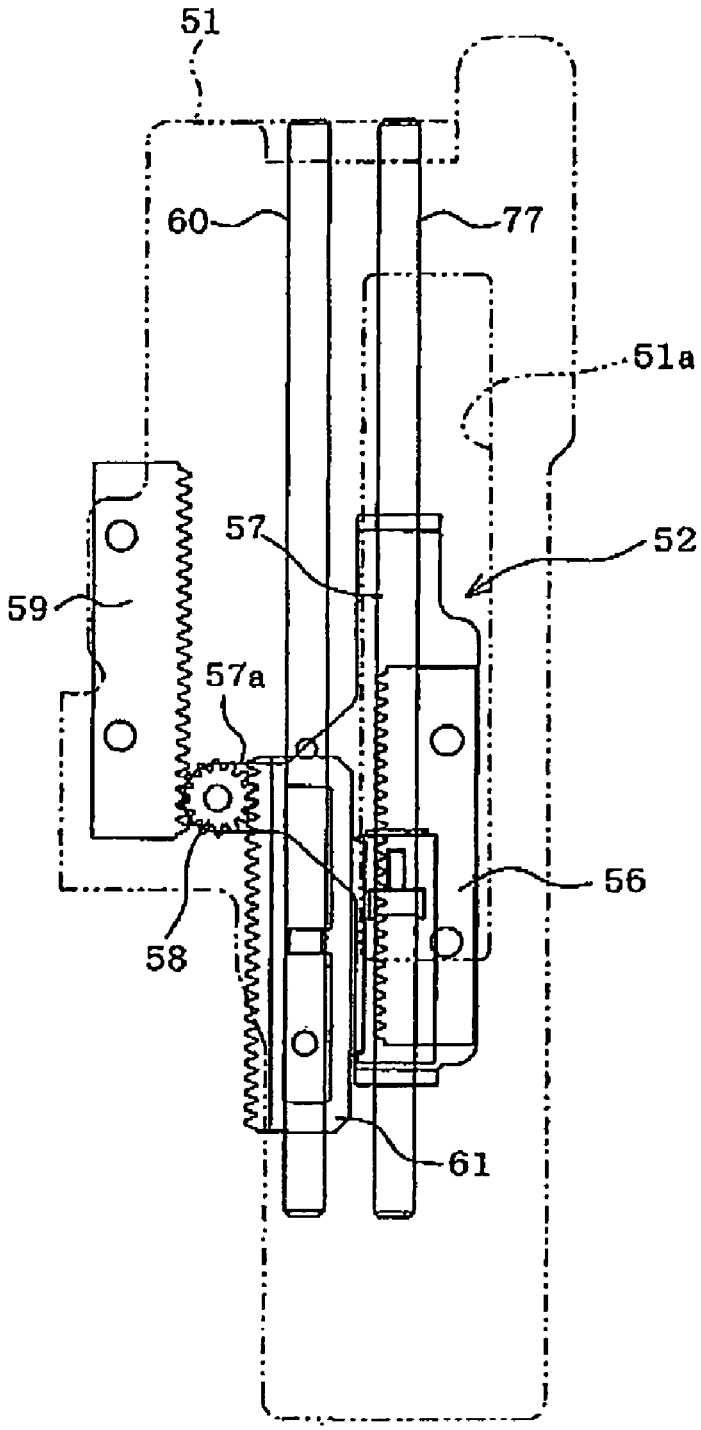

The intermediate gear 54 has a large diameter portion 54*a* and a small diameter portion 54*b* both of which are concentric and are rotated together. The large diameter portion 54*a* is in mesh engagement with the gear 53 of the rotating shaft 49*a*. The drive gear 55 also has a large diameter portion 55*a* and a small diameter portion 55*b* both of which are concentric and are rotated together. The large diameter portion 55*a* is in mesh engagement with the small diameter portion 54*b* of the intermediate gear 54. Furthermore, the small diameter portion 55*b* of the drive gear 55 is in mesh engagement with a moving member side rack 56 which will next be described. The rack and pinion mechanism 52 as a drive mechanism is built onto an underside of the sub-frame 51 as shown in FIGS. 4A to 4C. More specifically, the sub-frame 51 is provided with a slide shaft 77 extending vertically. A moving member 57 is supported on the slide shaft 77 so as to be vertically movable. A protrusion 57*a* protrudes from the left side of the moving member 57. A pinion 58 is pivotally mounted on a surface side of the protrusion 57*a*. A vertically extending rack 59 is mounted on a left intermediate portion of the sub-frame 51 so as to be directed rightward. A slider shaft 60 is mounted on the horizontal intermediate portion of the sub-frame 51 so as to extend vertically. A movable rack 61 is fitted with the slider shaft 60 so as to be vertically movable.

A moving member side rack 56 is mounted on the underside of the moving member 57 so as to be directed leftward and so as to extend vertically. The small-diameter portion 55*b* of the drive gear 55 is in mesh engagement with the rack 56. As a result, upon drive of the pulse motor 49, the moving member 57 is vertically moved via the gear mechanism 50. Furthermore, the pinion 58 is in mesh engagement with a right side of the fixed rack 59, and the movable rack 61 located opposite the fixed rack 59 with the pinion 58 being interposed therebetween. Consequently, the movable rack 61 is vertically moved with a stroke twice as large as an amount of vertical movement of the moving member 57, that is, an amount of movement of the pinion 58 relative to the fixed rack 59.

Figure 7:
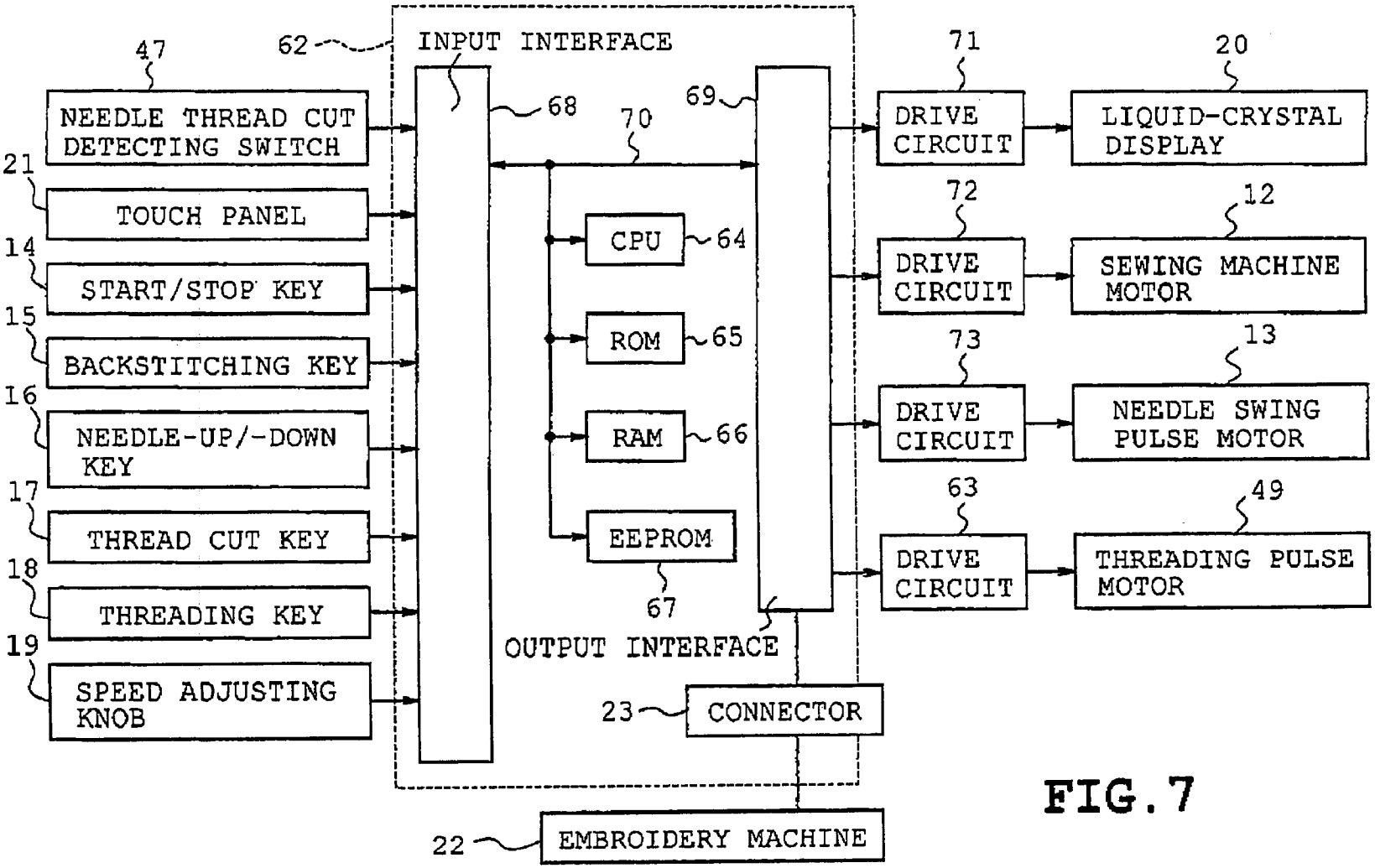
FIG. 7 is a block diagram showing an electrical arrangement of the sewing machine.

The sub-frame 51 has a vertically elongated opening 51*a* formed in the central part thereof as shown in FIGS. 4A to 4C. An operating strip 61*a* is formed integrally on the front of the movable rack 51 as shown in FIGS. 3A and 3B. The operating strip 61*a* extends through the opening 51*a* and is located in front of the sub-frame 51. The operating frame 61*a* is disposed above the protrusion 40*b* of the threading lever 40 as shown in FIG. 3B. Accordingly, when the movable rack 61 and accordingly the operating strip 61 are moved downward, the threading lever 40 is moved downward, whereby the threading shafts 27 and 28 (the threading mechanism 29) and the like are also moved downward. In this case, as shown in FIG. 7, the threading pulse motor 49 is controlled via a drive circuit 63 by a control device 62 which will be described later. In this case, the control device 62 controls the pulse motor 49 so that an operation as shown in FIG. 8 is executed as will be described in detail in the description of the operation. More specifically, the movable rack 61 is located at the uppermost position under a normal condition as shown in FIG. 4A. As a result, the protrusion 40*b* is not moved downward by the operating strip 61*a* such that the threading mechanism 29 is located at the retreat position (see FIG. 2A).

When the user turns on the threading key 18 once in the aforesaid state, a predetermined number P1 of pulses are supplied to the pulse motor 49 so that the pulse motor is energized. The movable rack 61 (the operating strip 61*a*) is moved downward such that the threading lever is moved downward by distance a, as shown in FIG. 4B. As a result, the threading mechanism 29 is moved to the thread guide preparation position as shown in FIG. 2B. Furthermore, when the user turns on the threading key 18 again in the above-described state, the predetermined number P2 of pulses are supplied to the pulse motor 49 so that the motor is energized. As a result, the movable rack 61 (the operating strip 61*a*) is further moved downward such that the threading lever 40 is moved downward by distance (b+c), as shown in FIG. 4C. Consequently, the threading mechanism 29 is moved downward to the threading operation position as shown in FIG. 2C, whereupon a threading operation is executed. Subsequently, the pulse motor 49 is reverse rotated at the number of times corresponding to the pulse number (P1+P2), whereby the movable rack 61 and the like are returned to the original position as shown in FIG. 4A. With this, the threading lever 40, the threading levers 27 and 28, the threading mechanism 29 and the like are also returned to the retreat position as shown in FIG. 2A. Alternatively, the pulse motor 49 may be operated when the needle thread cut detecting switch 47 as shown in FIG. 5B is actuated, instead of the second turn-on of the threading key 18 by the user, after movement of the threading mechanism 29 to the thread guide preparation position. In this case, the operation can be simplified since the user need not re-turn on the threading key 18.

FIG. 7 schematically illustrates an electrical arrangement of the sewing machine of the embodiment. The control device 62 comprises, as a main component, a microcomputer further comprising a CPU 64, a ROM 65, a RAM 66, an EEPROM 67, an input interface 68 and an output interface 69, all of which are connected to one another by buses 70. The ROM 65 stores a control program for control of a sewing operation and various data such as stitch data necessary for the sewing operation. To the input interface 68 are connected the needle thread cut detecting switch 47, touch panel 21, start/stop switch 14, backstitching key 15, needle-up/-down key 16, thread cut key 17, threading key 18 and speed adjusting knob 19. Operation signals are supplied from these components to the control device 62.

The liquid crystal display 20 is connected via the drive circuit 71 to the output interface 69. Furthermore, the sewing machine motor 12, needle swing pulse motor 13 and threading pulse motor 49 are connected via drive circuits 72, 73 and 74 to the output interface 69 respectively. As a result, the control device 62 controls the motors to execute a sewing operation. The aforesaid connector 23 is also connected to the output interface 69. In the embodiment, the control device 62 has a software configuration (the control program) on which the control device controls the needle threader 11 (the threading pulse motor 49) according to an operation of the threading key 18 by the user, whereby the operation as shown in FIG. 8 is realized. Thus, when the user operates the threading key 18, the threading mechanism 29 of the needle threader 11 is automatically moved among the retreat position, the threading operation position and the thread guide preparation position, and the threading operation is automatically executed.

Next, the operation of the above construction will be described. FIG. 8 shows a flow of threading operation of the needle threader 11 in the embodiment, that is, the relationship among the operation by the user, operation of the threading pulse motor 49 and the status of the needle threader 11. More specifically, the movable rack 61 (the operating strip 61*a*) is located at the uppermost position (see FIGS. 3A, 3B and 4A) and the threading mechanism 29 is located at the retreat position (see FIG. 2A) in the normal state or when the threading key 18 has not been operated by the user yet. Suppose now that the user desires to carry out a threading operation in which the needle thread T is caused to pass through the eye 7*a* of the needle 7, for example. In this case, firstly, the threading key 18 is turned on. The threading pulse motor 49 is then energized (the pulse number P1), and the movable rack 61 (the operating strip 61*a*) is moved downward and the threading lever 40 is moved downward by distance a (see FIG. 4B). As a result, the threading mechanism 29 is moved to the thread guide preparation position (see FIG. 2B).

The threading mechanism 29 (the threading hook 31, thread guide member 32 and thread holding member 33) is located just on the left of the needlebar clamp 8 of the needlebar 6 when assuming the thread guide preparation position. The user operates the needle threader 11 for preparation of the threading (the threading operation). The needle thread T has previously been passed through the predetermined path including the thread tension adjusting device. In the preparation operation, the user causes the distal end of the needle thread T to pass through the needlebar thread guide 26 of the needlebar 6 and thereafter hooks the distal end of the needle thread T on the thread guide member 32 so that the distal end is held. The distal end of the needle thread T is further held by the thread holding member 33. Thereafter, the distal end side of the needle thread T is inserted through the groove 45*a* of the thread cutter 45 so that an extra part of the distal end of the needle thread T is cut off by the cutting blade 46.

Subsequently, when the user turns on the threading key 18 again, the threading pulse motor 49 is energized (the pulse number P2), the movable rack 61 (the operating strip 61*a*) is further moved downward (see FIG. 4C), and the threading lever 40 is moved downward by distance (b+c). As a result, the threading mechanism 29 is moved downward to the threading operation position (by distance b). Furthermore, the threading hook 31 is pivotally moved reciprocally in the direction of arrow A by the pivot mechanism 30 (see FIG. 6A), so that the threading operation is executed. In this case, the threading pulse motor 49 may be operated when the needle thread cut detecting switch 47 is operated as shown in FIG. 5B, instead of re-turn-on of the threading key 18 by the user.

Subsequently, when the threading pulse motor 49 is rotated in the reverse direction by the pulse number (P1+P2), the threading hook 31 is pivotally moved in the direction of arrow B in FIG. 6B and accordingly, the movable rack 61 (the operating strip 61*a*) is moved upward by distance (a+b+c) thereby to be returned to the original position (see FIGS. 3A, 3B and 4A). With this, the threading lever 40 is moved upward by distance (a+b+c) by the spring force or the like, and the threading shafts 27 and 28 are also moved upward by distance (a+b), whereupon the threading mechanism 29 is returned to the retreat position (see FIG. 2A). In this state, the threading operation has been completed and the sewing operation is executable by the sewing machine body 1. The threading mechanism 29 (the threading hook 31, thread guide member 32 and the like) is held at the retreat position during the sewing operation.

Consider now the case where the user desires to interrupt the threading operation after the movement of the threading mechanism 29 to the thread guide preparation position for any reason, for example, for the reason that the user has erroneously operated the threading key 18. In this case, when the user touches a threading cancel key displayed on the liquid crystal display 20 (set on the touch panel 21), the number P1 of pulses is supplied to the threading pulse motor 49 so that the pulse motor is reverse rotated. As the result, the threading lever 40 is moved upward by distance a with the result that the threading mechanism 29 is returned to the retreat position.

According to the foregoing embodiment, the needle threader 11 is provided in the sewing machine for threading the needle 7 or causing the needle thread T to pass through the eye 7*a* of the needle 7. The threading mechanism 29 (including the threading hook 31 and the thread guide member 32) is moved to the retreat position during the sewing operation of the sewing machine body 1. When assuming the retreat position, the threading mechanism 29 is moved upward to the inside of the face plate 5*a* of the head 5. Accordingly, the threading mechanism 29 and the like can be prevented from blocking the user's view when he or she views the needle base portion including the needle 7 and the periphery thereof, whereupon the user's visibility can be improved.

Furthermore, the threading mechanism 29 is once moved to the thread guide preparation position in order that the threading operation may be executed. The user then needs to carry out the preparatory operation. In the embodiment, the threading shafts 27 and 28 and accordingly the threading mechanism 29 are automatically moved vertically or upward and downward by the vertical moving mechanism 34 driven by the threading pulse motor 49. Further, the threading mechanism 29 is automatically moved from the retreat position to the thread guide preparation position when the user turns on the threading key 18. Accordingly, the threading mechanism 29 and the like can be moved to the thread guide preparation position at any time by user's simple operation. Moreover, the threading operation can automatically be carried out when the threading key 18 is simply re-turned on.

Furthermore, particularly in the foregoing embodiment, the rack and pinion mechanism 52 constituting the drive mechanism comprises in combination the moving member 57 with the pinion 58, the fixed rack 59 and the movable rack 61. Consequently, the movable rack 61 and accordingly the threading shafts 27 and 28 and the like can vertically be moved with a stroke twice as large as an amount of vertical movement of the moving member 57, that is, an amount of movement of the pinion 58 relative to the fixed rack 59. Accordingly, the threading shafts 27 and 28 and the threading mechanism 29 can be moved with a larger stroke while the rack and pinion mechanism 52 has a reduced height.

Figure 9:
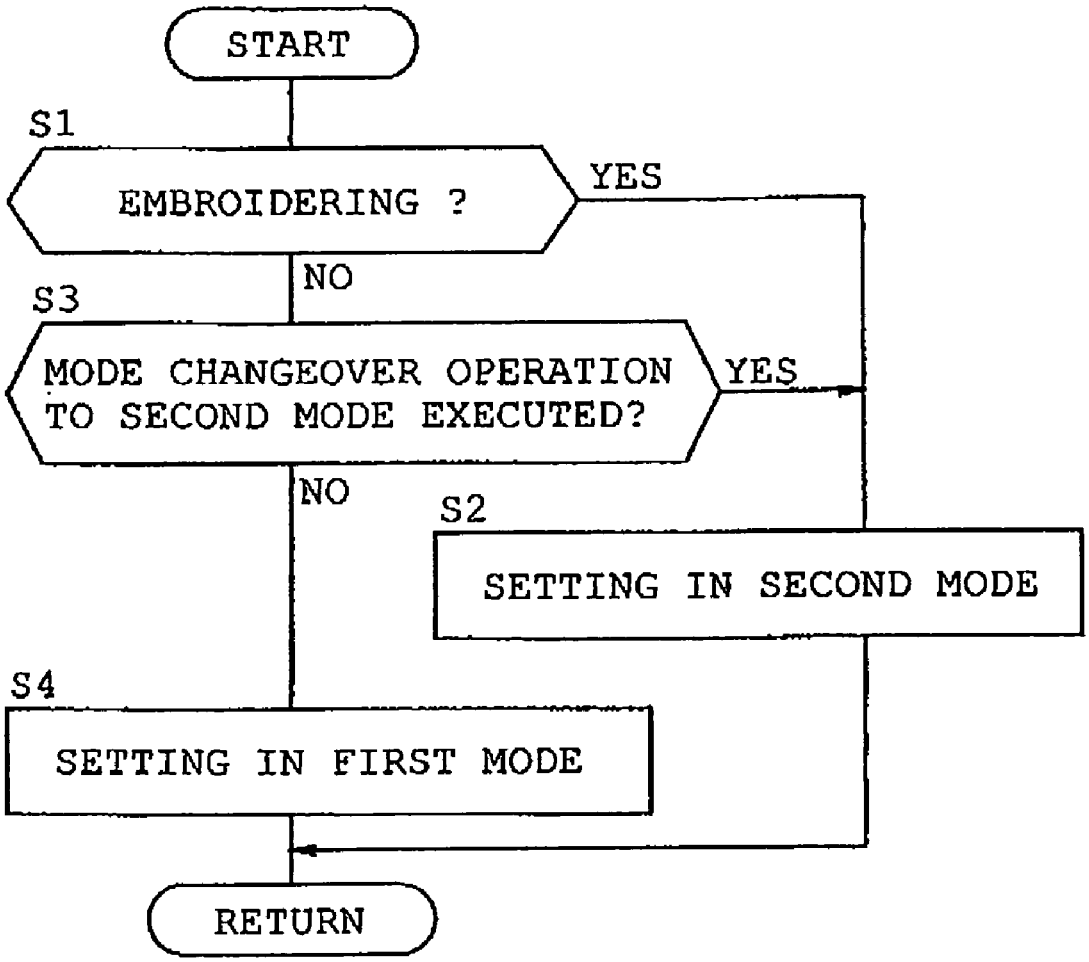
FIG. 9 is a flowchart showing the procedure of mode setting executed by a control device in the needle threader of a second example.

FIGS. 9 and 10 illustrate a second embodiment. The following second and third embodiments are each common to the first embodiment in the hardware construction including the sewing machine body 1 and the needle threader 11. Accordingly, identical or similar parts in the second and third embodiments are labeled by the same reference symbols as those in the first embodiment, and description of these parts will be eliminated. The following describes only the differences between each of the second and third embodiments and the first embodiment.

In the second embodiment, the sewing machine body 1 is provided with the needle threader 11 which is similar to that of the first embodiment. The control device 62 has a software configuration that provides two types of threading modes. The threading mechanism 29 is normally stopped at the retreat position in one threading mode, whereas the threading mechanism 29 is normally stopped at the thread guide preparation position in the other threading mode. The threading mechanism 29 is set in either threading mode. More specifically, the first threading mode has a flow of threading operation as described in the first embodiment with reference to FIG. 8. The threading mechanism 29 is normally located at the retreat position and moved to the thread guide preparation position when the user turns on the threading key 18 once. Subsequently, the threading operation is executed when the threading key 18 is turned on again. On the other hand, the threading mechanism 29 is normally located at the thread guide preparation position in the second threading mode. FIG. 10 shows a flow of threading operation in the second threading mode. In this case, the movable rack 61 (the operating strip 61*a*) is normally stopped at a position as shown in FIG. 4B, and the threading mechanism 29 is located at the thread guide preparation position as shown in FIG. 2B. Accordingly, the user can directly carry out the preparatory operation for causing the needle thread T to pass through the threading mechanism 29.

When the user turns on the threading key 18 after completion of the threading preparation, a predetermined number P2 of pulses are supplied to the threading pulse motor 49 so that the movable rack 61 (the operating strip 61*a*) is moved downward (see FIG. 4C) and the threading lever 40 is moved downward by distance (b+c). As a result, the threading mechanism 29 is moved downward to the threading operation position, executing the threading operation, as shown in FIG. 2C. Subsequently, the number P2 of pulses are supplied to the threading pulse motor 49 so that the motor is reverse rotated, whereupon the movable rack 61 and the like are returned to the position as shown in FIG. 4B. With this, the threading lever 40, threading shafts 27 and 28 and the like are also moved so that the threading mechanism 29 is returned to the thread guide preparation position as shown in FIG. 2B.

In the second embodiment, the control device 62 sets either threading mode in a procedure as shown in the flowchart of FIG. 9. Furthermore, the threading mode can be selected when the user operates the touch panel 21. Accordingly, the control device 62 and the touch panel 62 serve as a mode setting unit. Firstly, at step S1, it is determined whether an embroidering operation is executed. In this case, the determination can be made by selecting an embroidery pattern or an ordinary pattern on the touch panel 21. When the embroidery pattern has been selected, it is of course determined that the embroidering operation be executed. Alternatively, execution of the embroidering operation may be determined while the embroidery machine 22 is attached to the sewing machine bed 2. When the embroidering operation has been determined to be executed (YES at step S1), the second threading mode is set at step S2.

On the other hand, when it is not determined that the embroidering operation be executed (NO at step S1), the control device 62 advances to step S3 to determine whether an operation of changing the threading mode to the second mode has been carried out on the touch panel 21. In the case where an ordinary pattern has been selected, the first threading mode is automatically set (step S4) when the user does not carry out the mode changeover operation (NO at step S3). Accordingly, in the case where the user desires the second threading mode even when an ordinary stitch is executed, a mode changeover operation is carried out on the touch panel 21 in order that the threading mode may be changed from the first threading mode to the second threading mode (YES at step S3), whereupon the second threading mode is set (step S2).

An exchange frequency of the needle thread T is low when an ordinary stitch is to be executed by the sewing machine body 1. Furthermore, user's visibility needs to be improved when he or she views the needle base portion. In this case, the threading mechanism 29 is located at the retreat position during the sewing operation since the needle threader 11 is set in the first threading mode. Consequently, the user's visibility can be improved when he or she views the needle base portion.

On the other hand, the exchange frequency of the needle thread T (color exchange) is relatively higher when an embroidering operation is executed. Accordingly, the number of times of key operation is increased when the threading mechanism 29 is frequently returned from the retreat position to the thread guide preparation position, whereupon the working efficiency is reduced. In other words, much importance is not placed on user's visibility regarding the needle base portion in the case of the embroidering. Rather, workability and working efficiency are desired to be improved in the embroidering. Accordingly, since threading mechanism 29 is located at the thread guide preparation position upon selection of second threading mode has been selected, the working efficiency can be improved in the exchange (setting) of the needle thread T.

According to the second embodiment, the needle threader 11 has two threading modes. The threading mechanism 29 is normally located at the retreat position in the first or default threading mode, whereas the threading mechanism 29 is located at the thread guide preparation position in the second threading mode. The needle threader 11 can be set in either threading mode. As a result, since either threading mode can be used as the situation demands, the usability of the needle threader 11 can be improved. In particular, since either threading mode is automatically set according to the type of stitch pattern, user's operation to set the threading mode is not necessitated, whereupon the usability of the needle threader 11 can further be improved.

Figure 11:
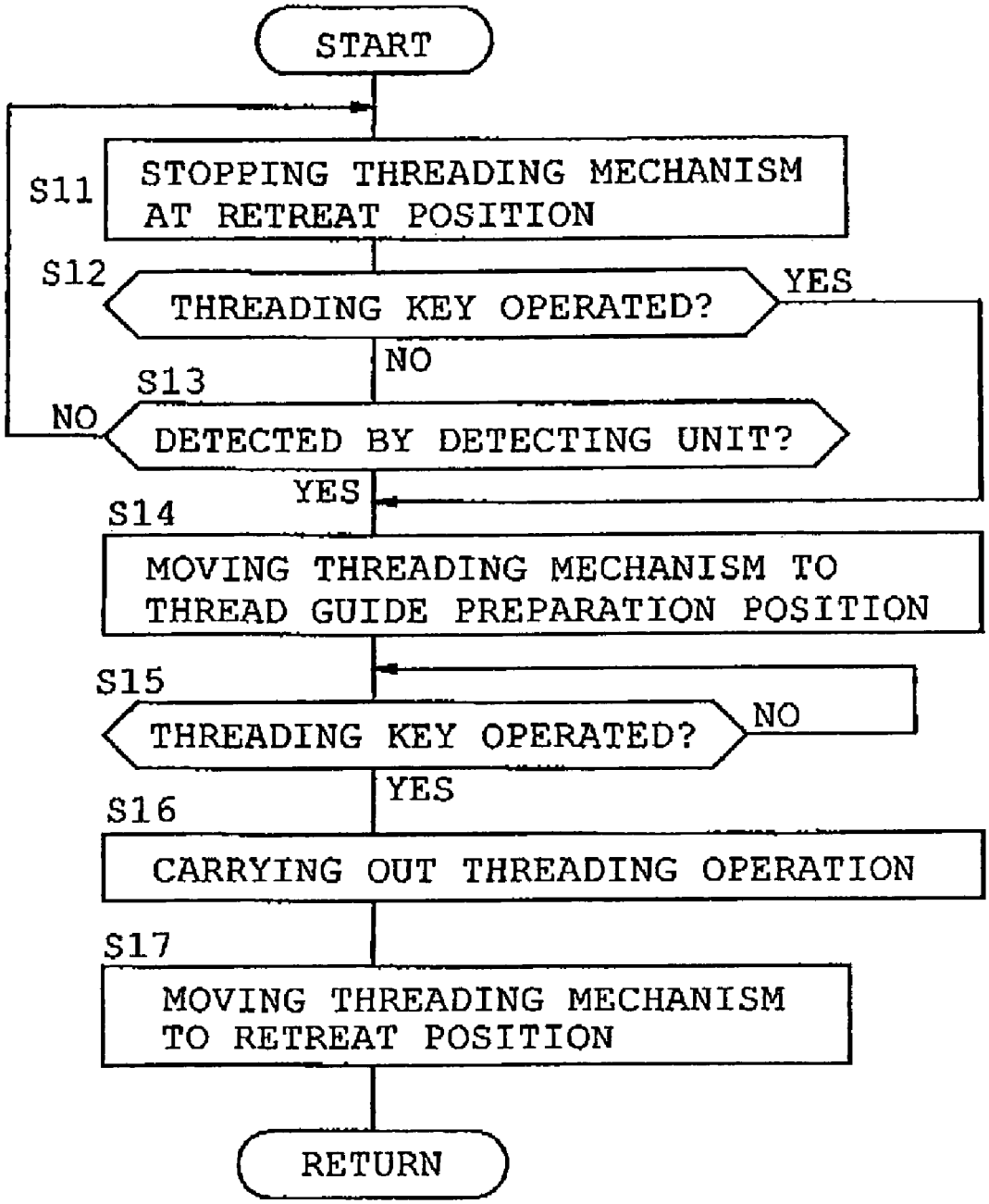
FIG. 11 is a flowchart showing the control procedure of threading operation executed by the control device in the needle threader of a third example.

FIG. 11 illustrates the third embodiment. In the third embodiment, the control device 62 executes the threading process in the procedure as shown in the flowchart of FIG. 11. In this case, the threading mechanism 29 is normally located at the retreat position. A detecting unit is provided in the sewing machine body 1 to detect whether the needle threading or causing the needle thread T to pass through the eye 7*a* of the needle 7 should be executed. For example, a sensor or switch may be employed as the aforesaid detecting unit. In this case, the sensor or switch directly or indirectly detects whether the needle 7 has been threaded or the needle thread T has been caused to pass through the needle eye 7*a* (or the needle 7 has been unthreaded). More specifically, a switch is provided in the sewing machine body 1 for detecting that the needle thread spool has been replaced (a former spool has been detached and a new spool has been attached). The switch may be used as the aforesaid detecting unit. A sensor is provided in the sewing machine body 1 for detecting that the needle thread T has been cut at any point in the path, based on the variations in the tension of the needle thread T. The sensor may be used as the aforesaid detecting unit. An optical sensor is provided in the sewing machine body 1 to detect that the needle thread T is present (or absent) at a predetermined position in the needle thread path. The optical sensor may be used as the aforesaid detecting unit. Additionally, a device is provided in the sewing machine body 1 for picking up an image of the eye 7*a* and its periphery by a CCD camera or the like thereby to monitor the needle thread T as to whether the needle 7 has been unthreaded. The device may be used as the aforesaid detecting unit.

The threading mechanism 29 is normally located at the retreat position (step S11) as shown in FIG. 11. At step S12, the control device 62 monitors the threading key 18 as to whether the threading key has been turned on. When the threading key 18 has been turned on by the user (YES at step S12), the control device 62 advances to step S14. When the threading key 18 has not been turned on (NO at step S12), the control device 62 advances to step S13 to determine whether a detecting operation has been executed by the above-mentioned detecting unit. When nothing has been detected by the detecting unit (NO at step S13), the control device 62 returns to step S11.

On the other hand, when the detecting unit has detected that the threading operation needs to be executed (YES at step S13), the control device 62 advances to step S14 where the threading mechanism 29 is moved to the thread guide preparation position under the control of the vertical moving mechanism 34. The threading mechanism 29 is also moved to the thread guide preparation position when the threading key 18 has been turned on (YES at step S12). As a result, the user can carry out a preparatory operation for the threading (thread guiding operation).

The threading operation is executed (step S16) when the user has turned on the threading key 18 (YES at step S15) after cut of the needle thread T by the thread cutter 46 (completion of the preparation for the threading). When the threading operation has been completed, the threading mechanism 29 is returned to the retreat position (step S17). Operation of the needle thread cut detecting switch may be detected, instead of on-operation of the threading key 18.

According to the third embodiment, the threading mechanism 29 is normally located at the retreat position as in the first embodiment. Accordingly, the threading mechanism 29 and the like can be prevented from blocking the user's view when he or she views the needle base portion including the needle 7 and the periphery thereof, whereupon the user's visibility can be improved. When the detecting unit has detected that the threading operation needs to be executed, the threading mechanism 29 is automatically moved to the thread guide preparation position. Consequently, user's instructing operation can be eliminated and accordingly, the operability of the needle threader 11 can be improved.

FIGS. 12A to 17B illustrate a fourth embodiment. The fourth embodiment is common to the first embodiment in the basic construction of the needle threader 11, that is, in the construction as shown in FIGS. 1 to 7. Accordingly, detailed description of the common construction is eliminated, and identical or similar parts in the fourth embodiment are labeled by the same reference symbols as those in the first embodiment, and description of these parts will be eliminated. FIGS.

1 to 7 will be referred to in the fourth embodiment. Furthermore, the needle threader will commonly be designated by reference numeral "11" in the fourth embodiment for the sake of convenience.

The needle threader 11 of the fourth embodiment is provided in the head 5 of the sewing machine body 1 as in the first embodiment and comprises the first and second threading shafts 27 and 28, the threading mechanism 29, the vertical moving mechanism 34, the pivot mechanism 30 and the threading lever 40. The vertical moving mechanism 34 further serves as an automatic position changeover unit.

The needle threader 11 of the fourth embodiment differs from that of the first embodiment in the provision of a manual operating mechanism 81 (see FIG. 12A etc.) which is operated to manually move the threading shafts 27 and 28 vertically. The manual operating mechanism 81 serves as a position changeover unit. More specifically, in the fourth embodiment, the vertical movement (displacement) and the threading operation of the threading mechanism can be carried out both manually and electrically (automatically).

Figure 12A:
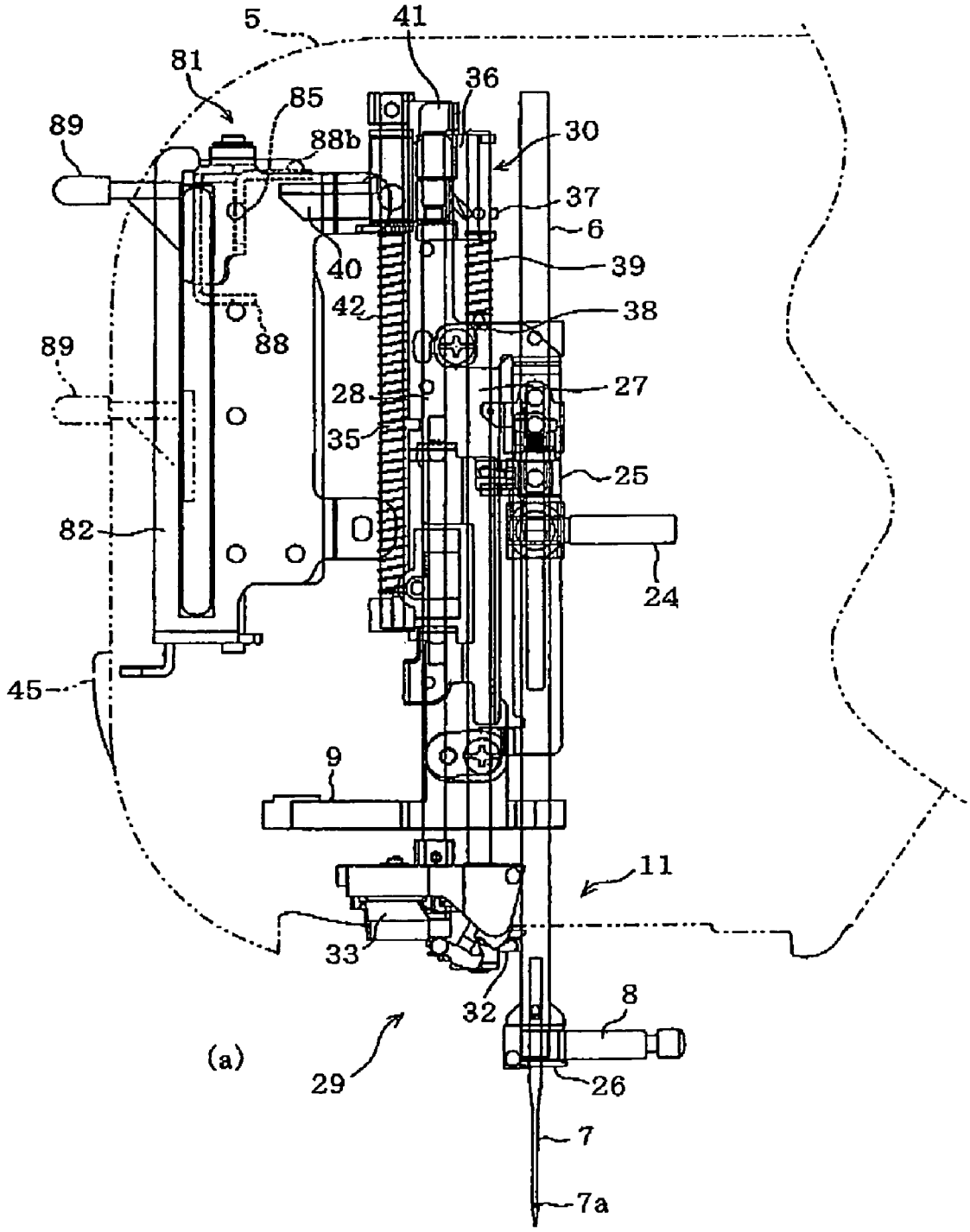
FIGS. 12A, 12B and 12C are front, right side and rear views of a manual operating mechanism in the needle threader of a fourth example respectively.
Figure 12B:
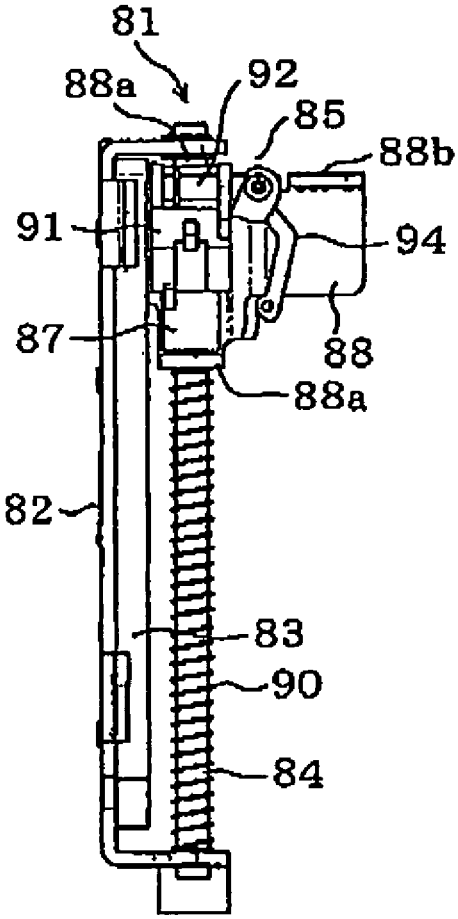
Figure 12C:
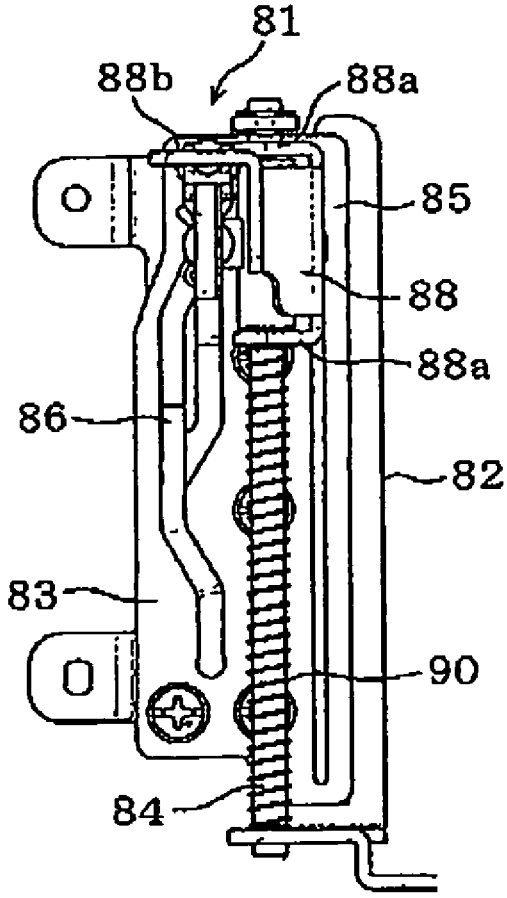

The manual operating mechanism 81 is constructed to vertically move the threading lever 40. The manual operating mechanism 81 includes an operation knob 89 which is disposed on a side of the head 5 so as to be operable as shown in FIG. 12A. The manual operating mechanism 81 further includes a holder 82 which is fixedly mounted in the head 5 so as to be located on the left of the needlebar frame 9, as shown in FIGS. 12A to 12C. A cam plate 83 made of an iron plate is screwed to the rear (back) of the holder 82. A vertically extending slider shaft 84 has both ends supported on the rear (back) of the holder 82 (cam plate 83). A slider 85 vertically moving the threading lever 40 is supported on the slider shaft 84 so as to be vertically movable.

The cam plate 83 is made from a resin and is formed into a vertically long rectangular plate shape as shown in FIGS. 14A to 14D. A grooved cam 86 is formed in a right portion of the rear of the cam plate 83 (a left portion as viewed in FIGS. 12C, 14A and 14C). The grooved cam 86 guides the slider 85 and constitutes a locking mechanism as will be described later. The slider shaft 84 is located just on the left of the grooved cam 86 at the rear (back) side of the holder 82 (on the right of the grooved cam as viewed in FIG. 12C).

The slider 85 includes a cylindrical portion 87 made from a resin as partially shown in FIGS. 13A-13D, 16A-16C, 17A and 17B. The cylindrical portion 87 is fitted into the slider shaft 84 so as to be vertically slidable. The slider 85 further comprises an iron slide plate 88, an operation knob 89, a select lever 91, a select pin 92 serving as an engagement protrusion, an urging spring 93, a reset lever 94 and a tension coil spring 95. The slide plate 88 has a sidewall located on the left of the cylindrical portion 87 as shown in FIGS. 12A-12C. The sidewall of the slide plate 88 has upper and lower sides bent rightward. The slide plate 88 has a pair of slide rings 88*a* which are disposed so that the cylindrical portion 87 is interposed therebetween. Thus, the slide rings 88*a* are located above and below the cylindrical portion 87 and fitted with the slider shaft 84. As a result, the cylindrical portion 87 and the slide plate 88 are vertically moved together. In this case, the slider 85 (the cylindrical portion 87, the slide plate 88 and the like) is normally urged upward by a compression coil spring 90 (as shown only in FIGS. 12B and 12C) carried about the slider shaft 84. The cylindrical portion 87 has a left outer wall further having an integrally formed protrusion 87*a* (see FIG. 13A), which is fitted into a hole (not shown) formed in the sidewall of the slide plate 88, whereby the cylindrical portion 87 is prevented from rotation.

The slide plate 88 has a sidewall further having a left side surface on which an operation knob 89 is mounted. The operation knob 89 has a distal end (a left end) which externally protrudes through a vertically elongate slit formed through the side surface (face plate 5*a*) of the head 5. As a result, the operation knob 89 can be moved downward by the user. The slide plate 88 has an integrally formed extension wall extending rightward from the sidewall and an integrally formed operation strip 88*b* extending rightward from an upper side of the extension wall. The operation strip 88*b* is disposed on an upper part of the threading lever 40. When the user manually moves the operation knob 89 and accordingly the slider 85 downward, the threading lever 40 can be moved downward.

Figure 13B:
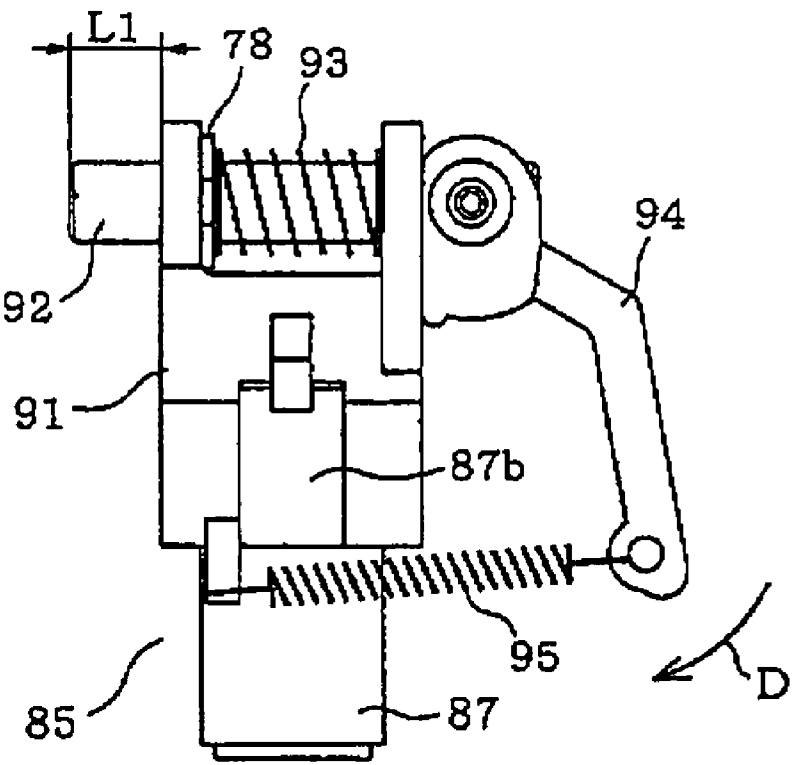
FIGS. 13A, 13B, 13C and 13D are right side views of the sliders including selecting pins having projection lengths of L1, L2 and L3 with a slide plate and operation knob being eliminated respectively.
Figure 13A:
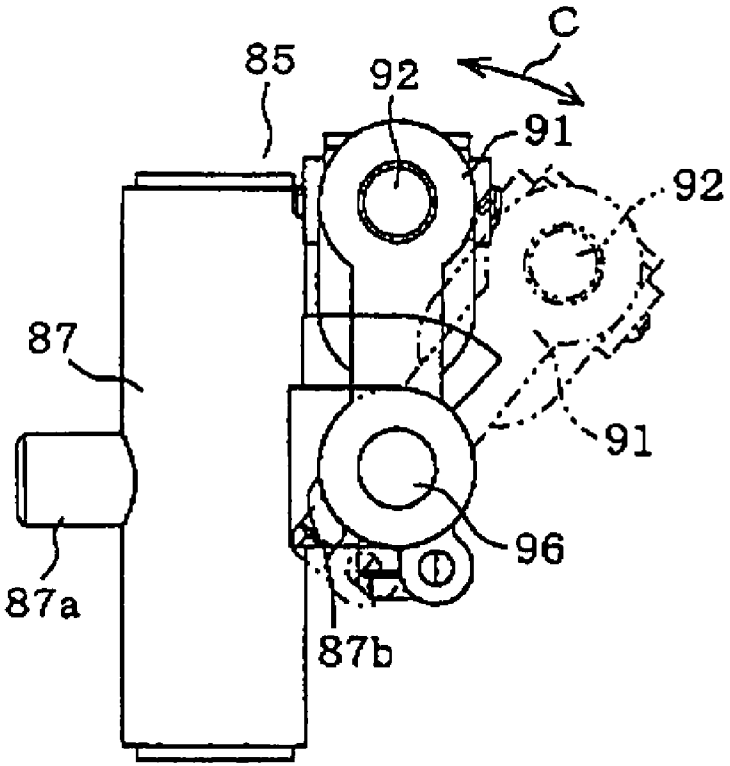

FIGS. 13A-13D, 16A-16C, 17A and 17B show the slider 85 with the slide plate 88 and the operation knob 89 being eliminated. The select lever 91 is formed into the shape of a link lever as viewed at the front and includes upper and lower sides each bifurcated into front and rear portions as shown in FIG. 13A and the like. The cylindrical portion 87 has a right outer wall further having an integrally formed bearing 87*b* protruding rightward. The select lever 91 has a lower portion pivotally mounted on the bearing 87*b* with the shaft 96 being interposed therebetween. The select lever 91 further has an upper portion that is located on the right of the cylindrical portion 87 and is slightly swingable in the direction of arrow C.

The select pin 92 is held on the upper portion of the select lever 91. The select pin 92 is supported on the bifurcated portion of the select lever 91 so as to be movable in the front-back direction. The select pin 92 has a proximal end (a rear end) connected to an upper end of the reset lever 94. The reset lever 94 is disposed behind the select lever 91 so as to be movable in the direction of arrow D and in the direction opposite arrow D. The reset lever 94 is urged in the direction of arrow D by a weak force of the tension coil spring 95 which is anchored to a lower end of the reset lever 94 and the select lever 91.

Furthermore, a retaining ring 78 is fixed to the select pin 92. An urging spring 93 is carried about a part of the select pin 92 located between the retaining ring 78 and the rear end of the bifurcated portion of the select lever 91. As a result, the select pin 92 is normally urged forward (leftward as viewed in FIGS. 13B-13D) by the urging spring 93. In this case, a spring force of the urging spring 93 acting on the select pin 92 is set so as to be larger that a spring force of the tension coil spring 95. Accordingly, the reset lever 94 assumes a non-pivot position as shown in FIG. 13B in the normal condition (or when no external force is applied to the reset lever 94). The distal end (the front end) of the select pin 92 protrudes forward from the select lever 91, being in engagement with a grooved cam 86 which will be described later. The select pin 92 is displaced horizontally along the grooved cam 86. With this, the select lever 91 is swung in the direction of arrow C as shown in FIG. 13A.

Figure 13D:
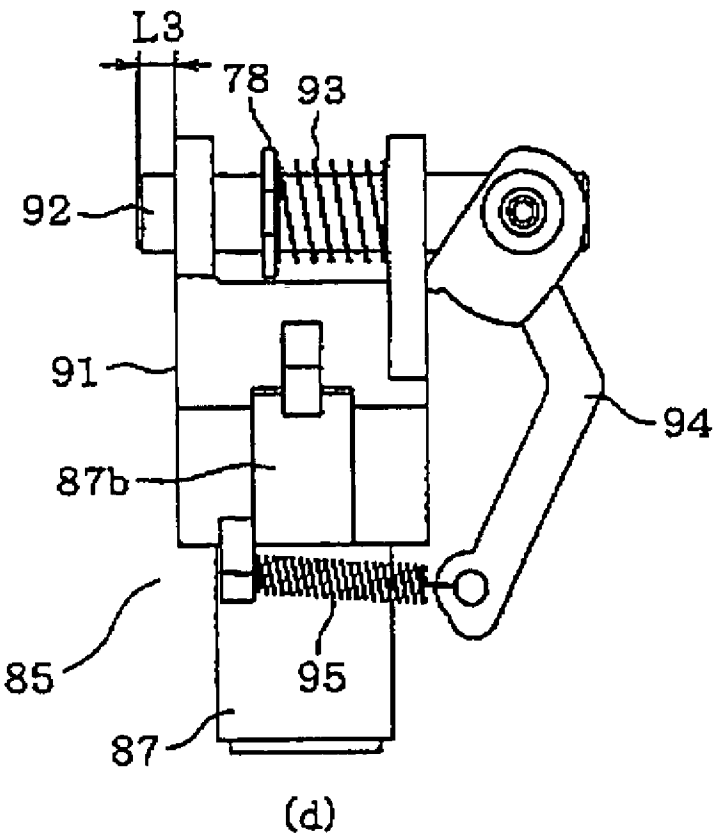
Figure 13C:
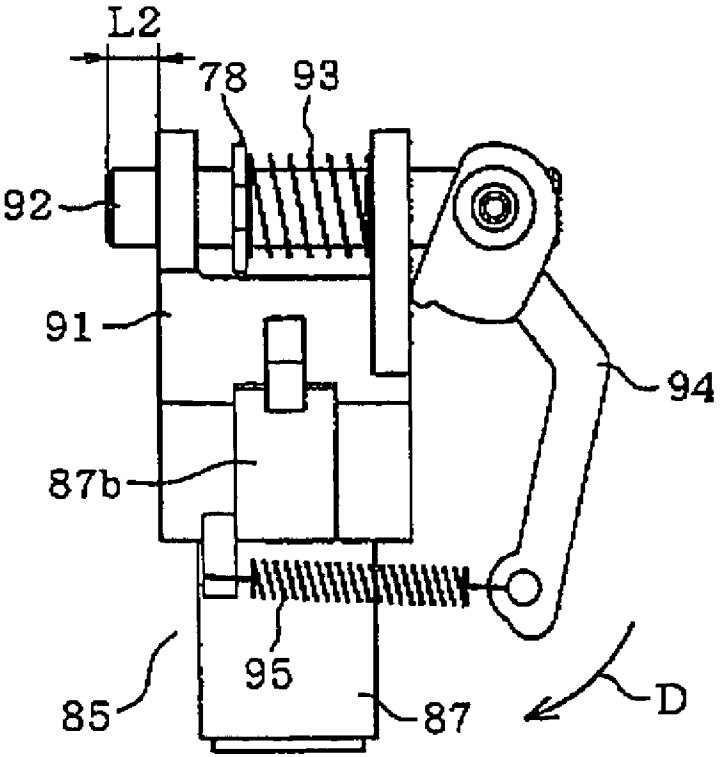

On the other hand, the upper end of the reset lever 94 is formed into a cam shape. Accordingly, the upper end (a part connected to the select pin 92) of the reset lever 94 is displaced rearward by a slight amount when the reset lever 94 is pivotally moved forcibly in the direction of arrow D against the spring force of the urging spring 93. The select pin 92 is then displaced so as to be withdrawn rearward, thereby being forcibly disengaged from the grooved cam 86. In this case, as shown in FIGS. 13B to 13D, the protruding portion of the select pin 92 from the end face of the select lever 91 has a maximum length L1 when the grooved cam 86 has a predetermined depth (a second locking portion 98 or the like as will be described later), as shown in FIG. 13B. When the grooved cam 86 is relatively shallower (a first locking portion 97 or the like as will be described later), the protruding portion of the select pin 92 has an intermediate length L2. The protruding portion of the select pin 92 has a minimum length L3 when the select pin 92 is disengaged from the grooved cam 86 by the pivotal movement of the reset lever 94 in the direction of arrow D, as shown in FIG. 13D.

Figure 17A:
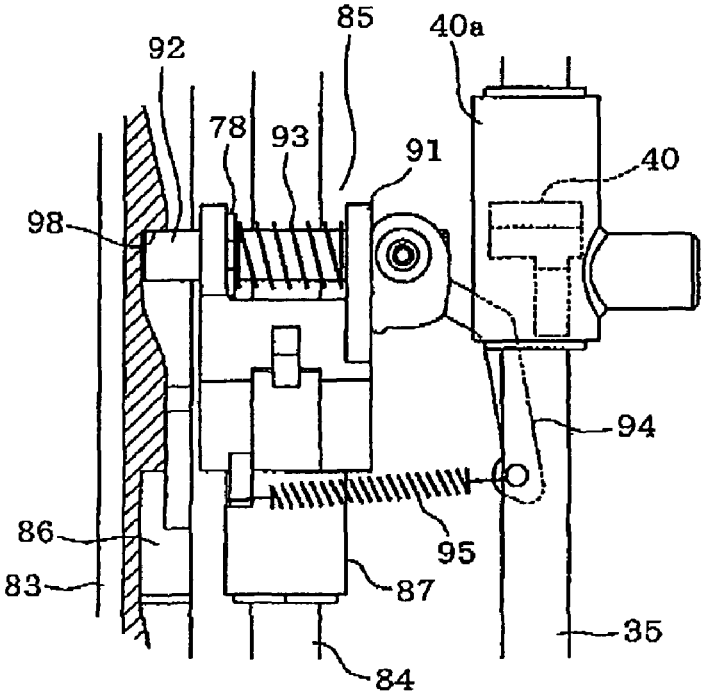
FIG. 17A is a right side view of the slider stopped at the second position.
Figure 17B:
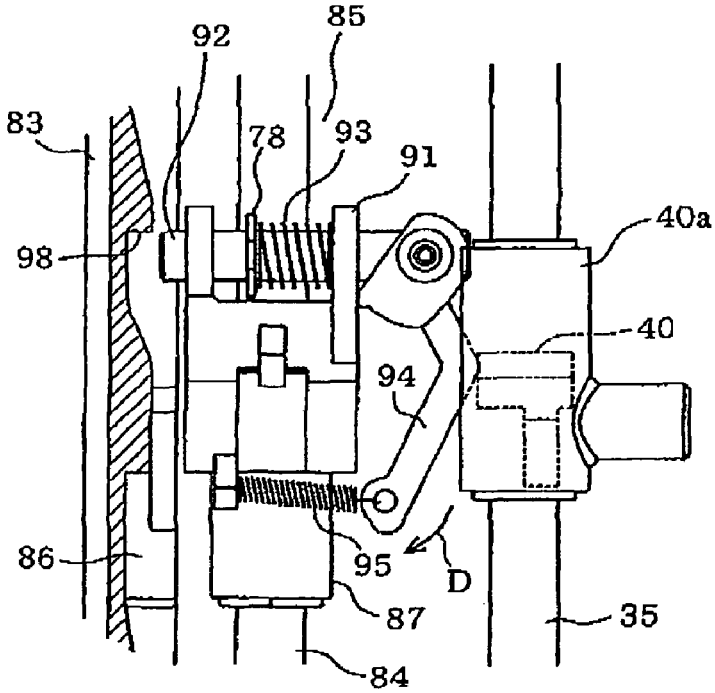
FIG. 17B is a right side view of the slider, showing the case where a rest lever is pivotally moved by the threading lever.

The threading lever 40 presses the reset lever 94 to pivotally move the reset lever 94 forcibly in the direction of arrow D when the threading lever 40 is vertically moved so as to pass through the side of the reset lever 94 while the select pin 92 is in engagement with the second locking portion 98 of the grooved cam 86, as shown in FIGS. 17A and 17B. As a result, the select pin 92 is disengaged from the grooved cam 86. A reset unit is thus constructed. The threading lever 40 is constructed so as not to interfere with the reset lever 94 when the reset lever 94 assumes the position as shown in either FIG. 13C or 13D.

The grooved cam 86 will now be described with further reference to FIGS. 14A to 16C. The grooved cam 86 is provided in the cam plate 83 to guide the select pin 92 (and accordingly the slider 85). FIGS. 14A, 14C and 15A to 15C show a configuration of the grooved cam 86 as viewed at the rear of the needle threader 11. The first locking portion 97 is formed on an upper end of the grooved cam 86. The grooved cam 86 further has a lower end serving as a threading position 99. The grooved cam 86 further includes an intermediate portion that is located below the first locking portion 97 and formed with a second locking portion 98. The locking portions 97 and 98 are formed so as to have respective walls locking the select pin 92 moved from below as the slider 85 is normally urged upward by the compression coil spring 90.

Figures 16A, 16B, 16C:
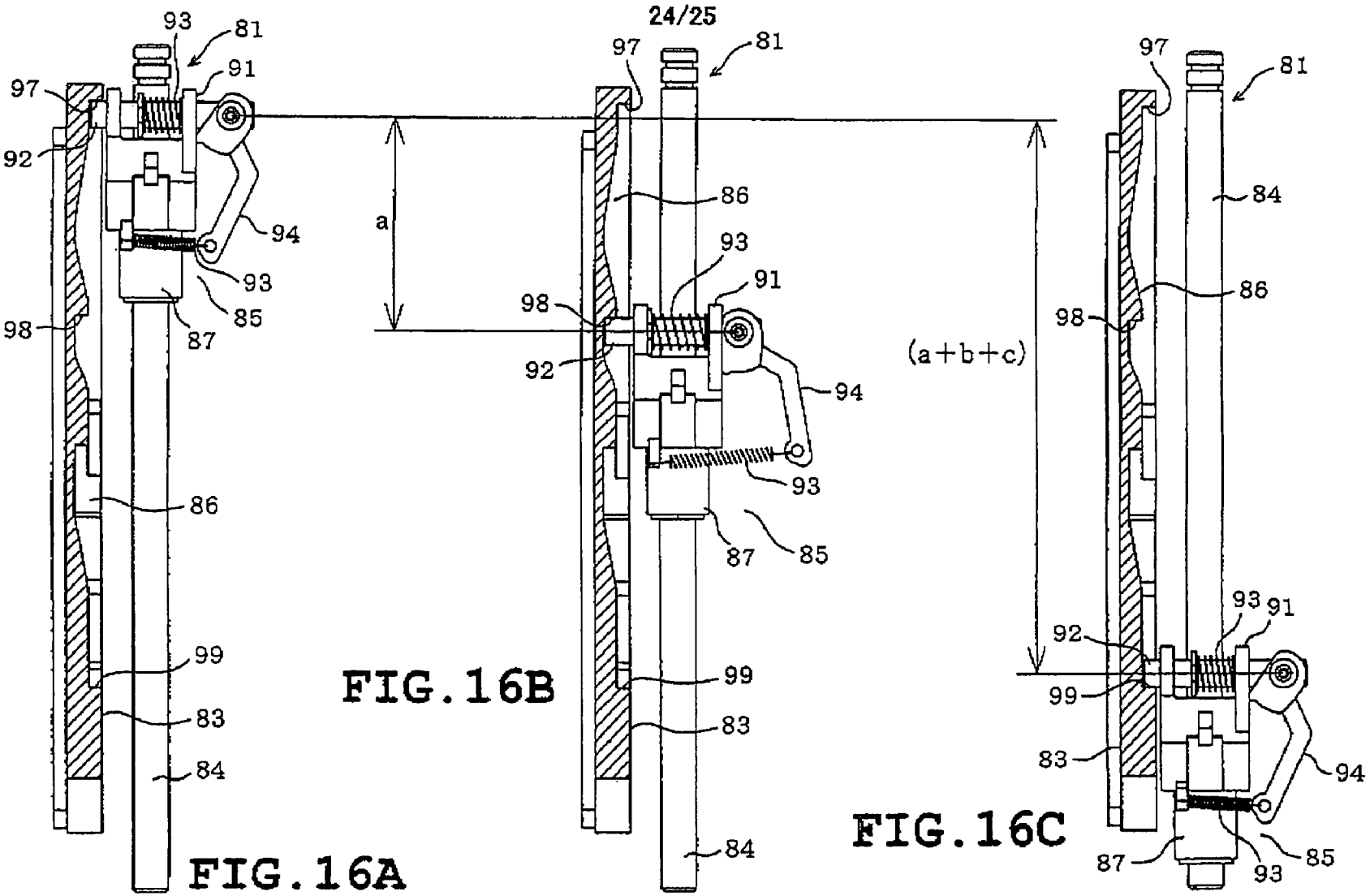
FIGS. 16A, 16B and 16C are longitudinal sectional right side views of the sliders in first, second and third positions respectively.

The slider 85 is stopped at a first position that is the position of the upper end of the slider shaft 84 when the select pin 92 is locked at the first locking portion 97, as shown in FIG. 16A. Furthermore, the slider 85 is stopped at a second position when the select pin 92 is locked at the second locking portion 98, as shown in FIGS. 16B and 17A. Still furthermore, the slider 85 is moved downward to a third position when the select pin 92 is moved downward to the threading position 99 at the lower end of the grooved cam 86, as shown in FIG. 16C. The first to third positions of the slider 85 correspond to the retreat position, the thread guide preparation position and the threading position of the threading mechanism 29 (the threading lever 40) respectively.

Figure 14A:
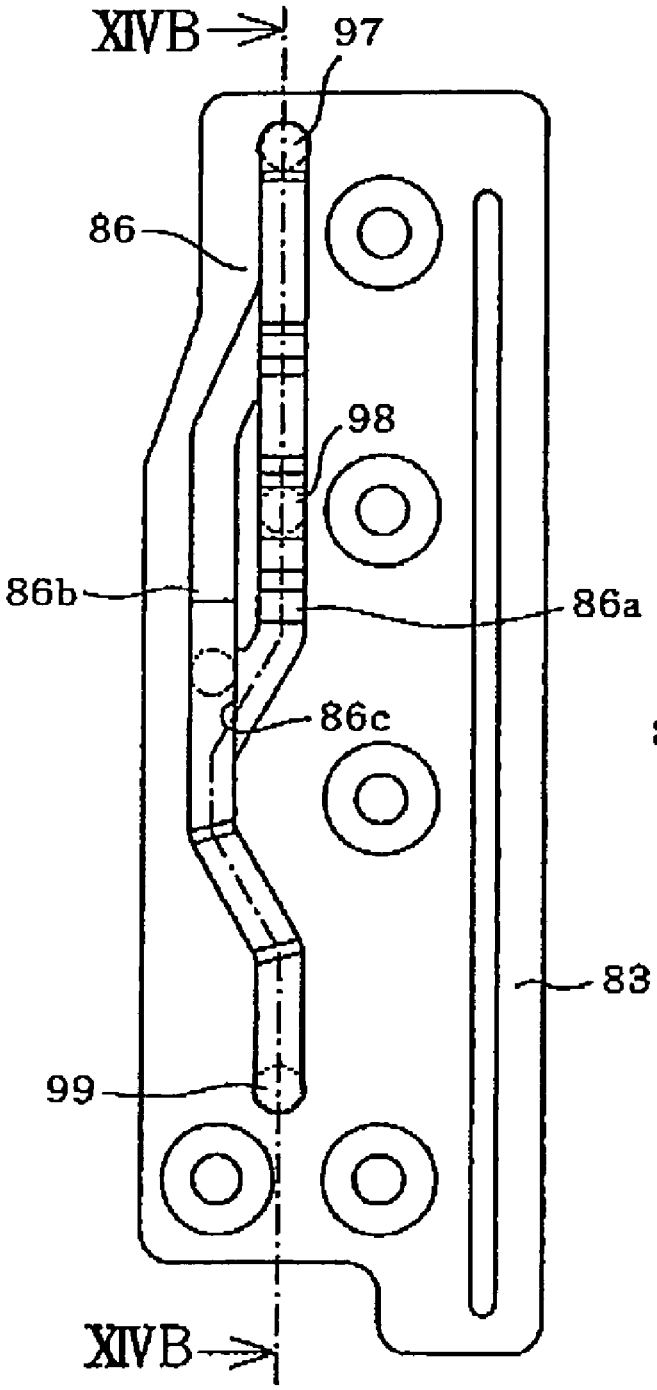
FIG. 14A is a rear view of a cam plate, showing a configuration of a grooved cam.

The grooved cam 86 is configured so as to include right and left bifurcated paths in an intermediate portion thereof between the upper and lower ends as shown in FIGS. 14A, 14C and 15A to 15C. As a result, the grooved cam 86 has a first path 86*a* along which the select pin 92 is moved downward from the first locking portion 97 through the second locking portion 98 to the threading position 99 and a second path 86*b* along which the select pin 92 is returned from the threading position 99 to the first locking position 97 without passing the second locking portion 98. The first path 86*a* runs straight downward from the first locking portion 97 and further slightly obliquely leftward after having passed the second locking portion 98 as viewed in FIG. 14A. After having passed a first step 86*c*, the first path 86*a* further runs downward slightly obliquely rightward. The first path 86*a* further runs straight to the threading position 99 (see FIG. 15A). On the other hand, the second path 86*b* runs straight upward from the threading position 99 and thereafter upward slightly obliquely leftward as shown in FIG. 14A. After having passed a second step 86*d*, the second path 86*b* further runs straight upward to the first locking portion 97 (see FIG. 15B).

Figure 14B:
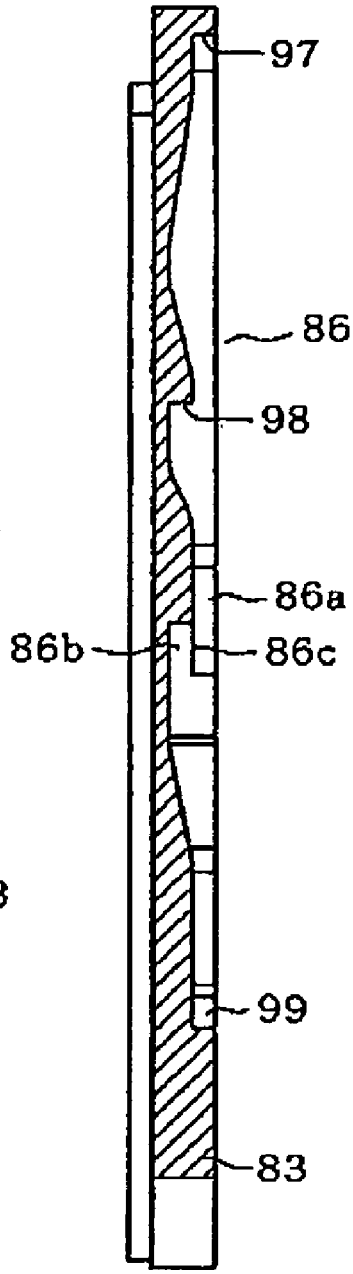
FIG. 14B is a longitudinal sectional right side view of the cam plate taken along line I-I in FIG. 14A.
Figure 14C:
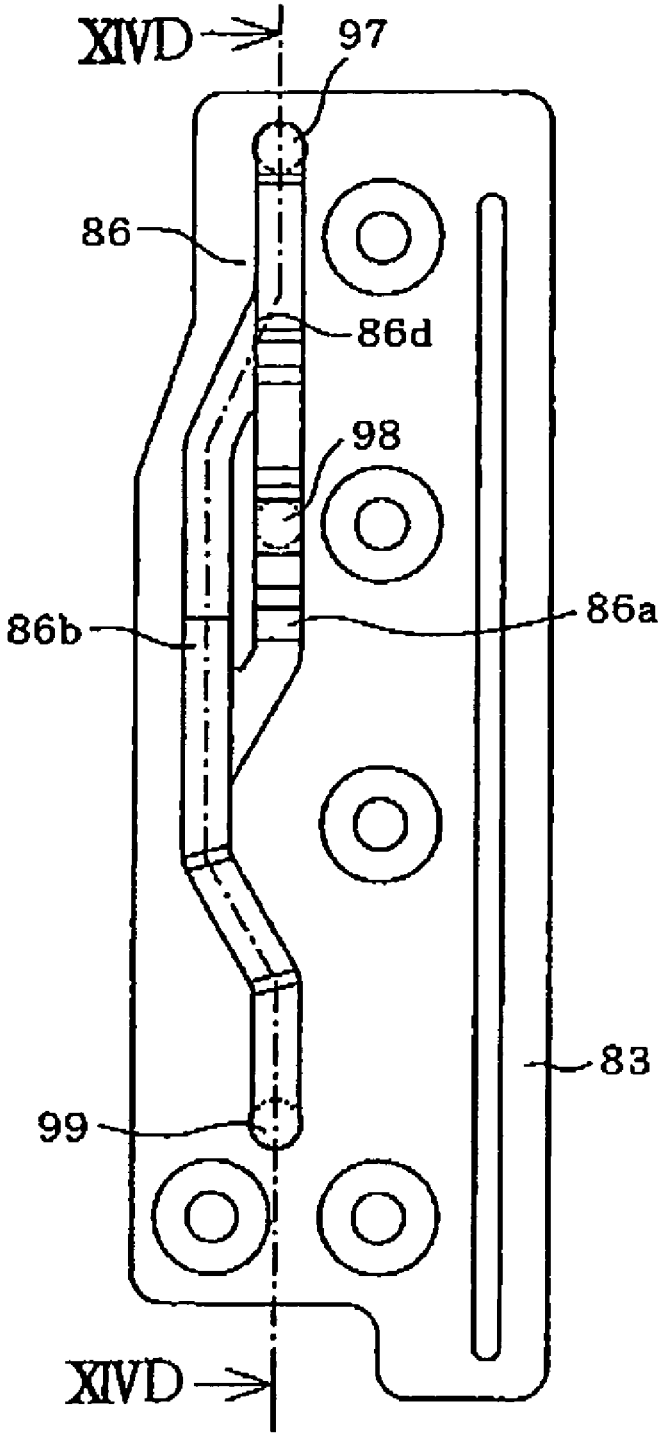
FIG. 14C is a rear view of a cam plate, showing another configuration of a grooved cam.
Figure 14D:
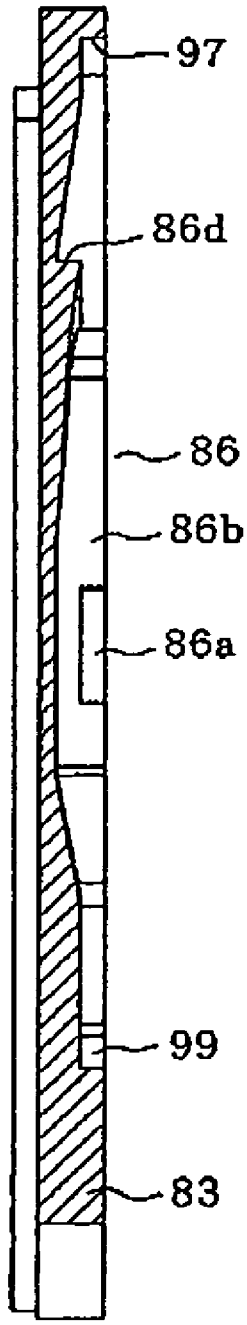
FIG. 14D is a longitudinal sectional right side view of the cam plate taken along line II-II in FIG. 14C.

FIG. 14B shows a sectional configuration of the grooved cam 86 (the cam plate 83) taken along line I-I in FIG. 14A. FIG. 14D shows a sectional configuration of the grooved cam 86 (the cam plate 83) taken along line II-II in FIG. 14C. The first step 86*c* sinks or is rendered deeper toward the second step 86*b* side. The second step 86*d* sinks or is rendered deeper toward the first path 86*a*. The steps 86*c* and 86*d* prevent backward movement of the select pin 92.

Under the normal condition, that is, when the operation knob 89 has not been operated by the user and the vertical moving mechanism 34 has not been operated, the select pin 92 is locked at the first locking portion 97 of the grooved cam 86 and the slider 85 is stopped at the first position, as shown in FIGS. 12A to 12C and 16A. In this state, as shown in FIG. 12A, the operation strip 88*b* of the slide plate 88 of the slider 85 is located above the threading lever 40 such that no downward force is applied to the threading lever 40, whereupon the threading mechanism 29 is located at the retreat position (see FIG. 2A). In this state, when the user moves the operation knob 89 downward, the slider 85 is moved downward while the select pin 92 guided along the first path 86*a* of the grooved cam 86. In the case where the user stops moving the operation knob 89 when the select pin 92 has run past the second locking portion 98, the select pin 92 engages the second locking portion 98 as shown in FIG. 16B. In this state, further upward movement of the select pin 92 is prevented and accordingly, the slider 85 is stopped at the second position. As a result, the operating strip 88*b* of the slider 85 moves the threading lever 40 downward by distance a, whereupon the threading mechanism 29 is moved to the thread guide preparation position as shown in FIG. 2B.

When the user further moves the operation knob 89 downward in this state, the slider 85 is moved downward while being guided along the first path 86*a* of the grooved cam 86. When the select pin 92 has been moved to the threading position 99 at the lower end of the grooved cam 86, the slider 85 reaches the third position. As a result, the operating strip 88*b* further moves the threading lever 40 downward by distance (b+c), so that the threading operation is executed, as shown in FIG. 2C.

The slider 85 is moved upward by the spring force of the compression coil spring 90 when the user has stopped applying the downward force to the operating knob 89 after completion of the threading operation of the threading mechanism 29. The slider 85 is returned to the first position while the select pin 92 is guided along the second path 86*b* of the grooved cam 86 (see FIG. 15B). Since the select pin 92 does not pass the second engagement portion 98 in this case, the slider 85 is returned at once to the first position (see FIG. 16A) without stopping at the second position. Consequently, the threading lever 40 is moved upward, and the threading hook 31 and other parts are returned. Continuously, the whole threading mechanism 29 is returned upward to the retreat position (see FIG. 12A). Indications of positions of the operation knob 89 are provided on the surface of the face plate 5*a* of the head 5 although not shown in the drawings. The indications correspond to the retreat position, the thread guide preparation position, the threading operation position and a cancel position that will be described later, respectively. The indications help the user operate the operation knob 89.

Figures 15A, 15B, 15C:
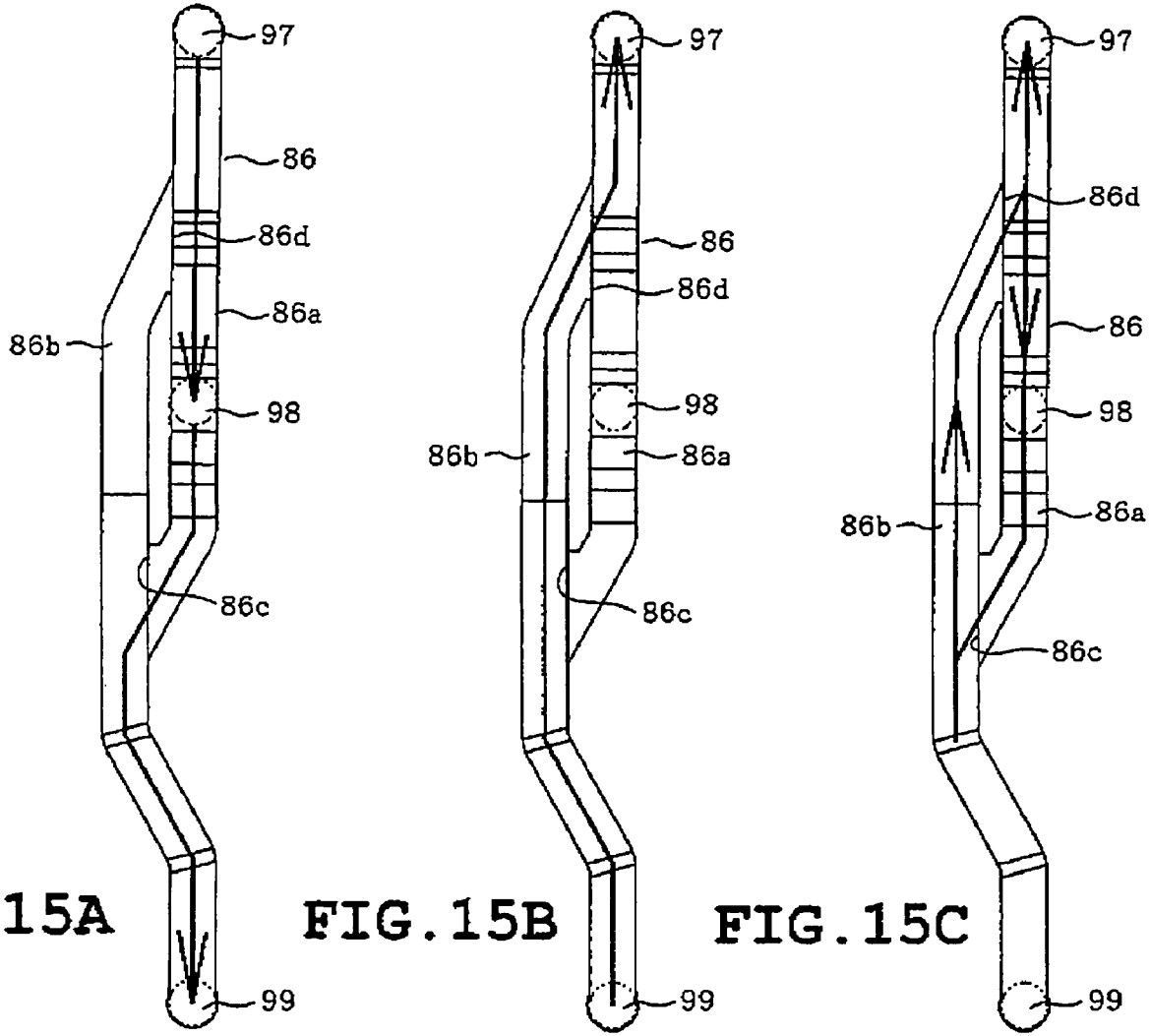
FIGS. 15A, 15B and 15C show a first path, a second path and a path in the case of cancellation in a grooved cam respectively.

A case can be considered where the user desires to return the threading mechanism 29 to the retreat position without execution of the threading operation although the user has operated the operation knob 89 to move the slider 85 to the second position thereby to move the threading mechanism 29 to the thread guide preparation position. According to the structure of the grooved cam 86, the slider 85 is moved downward to a cancel position (the position of the select pin 92 downwardly moved past the first step 86*c*) between the second and third positions. As a result, the threading mechanism 29 can be returned to the retreat position by returning the slider 85 directly to the first position without being moved to the third position. More specifically, the user moves the operation knob 89 downward thereby to move the slider downward when the select pin 92 is locked at the second locking portion 98 of the grooved cam 86 such that the slider 85 is stopped at the second position. The operation knob 89 is then released from the applied downward force when the select pin 92 has run past the first step 86*c* (the cancel position of the slider 85). The select pin 92 is moved from the first path 86*a* to the second path 86*b* when having run past the first step 86*c*, as shown in FIG. 15C. Accordingly, when the operation knob 92 is released from the applied downward force, the spring force moves the slider 85 upward along the second path 86*b* to the first position. Consequently, the threading mechanism 29 is returned to the retreat position.

The operation of the needle threader will now be described. For example, the slider 85 of the manual operating mechanism 81 is stopped at the first position in a normal condition where the operation knob 89 has not been operated and threading key 18 has not been turned on after completion of the previous threading operation, as shown in FIGS. 12A to 12C and 16A. Furthermore, the movable rack 61 of the vertical moving mechanism 34 is located at the uppermost position. As a result, the threading lever 40 is stopped at the uppermost position and the threading mechanism 29 is located at the retreat position inside the face plate 5*a* of the head 5, as shown in FIG. 2A. In this state, the user can cause the sewing body 1 to execute a sewing operation.

Now, when desiring to operate the manual operating mechanism 81 so that a new needle thread T is caused to pass through the eye 7*a* of the needle 7, the user moves the operation knob 89 downward until the slider 85 assumes the second position. The operating strip 8*b* of the slider 85 moves the threading lever 40 downward by distance a, whereupon the threading mechanism 29 is moved to the thread guide preparation position (see FIG. 2B). In this state, the select pin 92 is locked by the second locking portion of the grooved cam 86 and accordingly, the threading lever 40 is held at the corresponding position, whereupon the threading mechanism 29 is stopped at the thread guide preparation position. When assuming the thread guide preparation position, the threading mechanism 29 (the threading hook 31, the thread guide member 32 and the thread holding member 33) is located just on the left of the needlebar clamp 8 of the needlebar 6. The user then carries out preparation for the threading operation (the thread guide operation). In this state, when the user desires to return the threading mechanism 29 to the retreat position in the manner as described above, the operation knob 89 is moved downward a slight amount so that the slider 85 is moved to the cancel position. As a result, the select pin 92 is moved along the path as shown in FIG. 15C and accordingly, the slider 85 is returned to the first position, whereupon the threading lever 40 and accordingly the threading mechanism 29 can be returned to the formed position.

In the preparation for the threading operation, the user causes the distal end of the needle thread T which has passed through a predetermined path including the thread tension device to pass through the needlebar thread guide 26 of the needlebar 6 and thereafter, the user hooks the distal end of the needle thread T on the thread guide member 32 so that the needle thread T is held by the thread guide member 32. Subsequently, the distal end of the needle thread T is caused to pass through the groove 45*a* of the thread cutter 45 so that an excess part of the needle thread T is cut off by the thread cutter 46. This renders the threading operation executable, and the user continuously moves the operation knob 89 downward until the slider 85 reaches the third position (see FIG. 16C). As a result, when the threading lever 40 is pressed down by the operating strip 88*b* by distance (b+c), the threading mechanism 29 is moved downward to the threading operation position (by distance b) (see FIG. 2C), and furthermore, the pivot mechanism 30 pivotally moves the threading hook 31 reciprocally in the directions of arrows A and B (see FIGS. 6A and 6B), whereby the threading operation is executed.

Subsequently, when the user releases the operation knob 89 from the pressed state, the slider 85 is returned to the first position while guided along the second path 86*b* of the grooved cam 86 as described above. With this, the threading lever 40 is moved upward by distance (a+b+c) by the spring force or the like, and the threading shafts 27 and 28 are also moved upward by distance (a+b), whereupon the threading mechanism 29 is returned to the retreat position (FIG. 2A). In this state, a sewing operation is executable by the sewing machine body 1. The threading mechanism 29 including the threading hook 31 and the thread guide member 32 is held at the retreat position during the sewing operation.

Furthermore, the threading key 18 is turned on when the user desires the threading operation to be executed automatically (electrically) with the use of the vertical moving mechanism 34 while the threading mechanism 29 is located at the retreat position. When the threading pulse motor 49 is then energized (pulse number P1), the movable rack 61 (the operating strip 61*a*) is moved downward, the threading lever 40 is pressed downward by distance a and the threading mechanism 29 is moved to the thread guide preparation position. The user then turns on the threading key 18 again after having carried out the threading preparation operation (thread guide operation) in the same manner as described above. As a result, the threading pulse motor 49 is energized (pulse number P2) so that the movable rack 61 is moved downward (see FIG. 4C) and the threading lever 40 is pressed downward by distance (b+c). Consequently, the threading mechanism 29 is moved downward to the threading operation position (by distance b) and the threading operation is then executed. In this case, too, the threading pulse motor 49 may be operated upon operation of the needle thread cut detecting switch 47, instead of the second turn-on of the threading key 18 by the user.

Subsequently, the threading pulse motor 49 is reverse rotated according to the pulse number (P1+P2) so that the movable rack 61 (the operating strip 61*a*) is moved upward by distance (a+b+c) thereby to be returned to the original position (FIGS. 3A, 3B and 4A). With this, the threading mechanism 29 is returned to the retreat position (FIG. 2A). The slider 85 of the manual operating mechanism is stopped at the first position during the threading operation with the use of the vertical moving mechanism 34 as described above. The threading lever 40 is not operated, and the reset lever 94 is not pressed by the cylindrical portion 49*a* of the threading lever 40.

Consider now the case where the user changes the operation mode to the automatic mode with the use of the vertical moving mechanism for execution of the threading operation after having manually moved the threading mechanism 29 to the thread guide preparation position using the manual operating mechanism 81. In this case, the threading operation is carried out while the slider 85 of the manual operating mechanism 81 is retained at the second position (the select pin 92 is locked at the second locking portion 98 of the grooved cam 86). This would result in an obstacle when the threading lever 40 is returned to the uppermost position after the threading (the threading mechanism 29 can be returned only to the thread guide preparation position.

In the embodiment, however, the above-described failure can be prevented by the reset unit as shown in FIGS. 17A and 17B. More specifically, the select pin 92 is locked at the second locking portion 98 of the grooved cam 86 when the slider 85 is stopped at the second position, as shown in FIG. 17A. In this case, as shown in FIG. 13B, the protruding portion of the select pin 92 has the maximum length L1, and the lower end of the reset lever 94 has been moved slightly rightward. In this state, when the threading operation is carried out by the vertical moving mechanism 34, the threading lever 40 is moved along the guide shaft 35 in the rear of the reset lever 94 of the slider 85 as shown in FIG. 17B. In this case, the threading lever 40 abuts against the reset lever 94 thereby to be pivotally moved forcibly in the direction of arrow D in FIG. 13B, whereupon the select pin 92 is withdrawn thereby to be disengaged from the grooved cam 86. As a result, the slider 85 is moved upward along the first path 86*a* by the spring force of the compression coil spring 90 thereby to be returned to the first position. This prevents the above-described failure in the returning of the threading lever 40 after the threading operation.

According to the foregoing fourth embodiment, the needle threader 11 is provided in the sewing machine for threading the needle 7 or causing the needle thread T to pass through the eye 7*a* of the needle 7. The threading mechanism 29 (including the threading hook 31 and the thread guide member 32) can be located at the retreat position where the threading mechanism 29 is moved upward to the inside of the face plate 5*a* of the head 5. Accordingly, the threading mechanism 29 and the like can be prevented from blocking the user's view when he or she views the needle base portion including the needle 7 and the periphery thereof, whereupon the user's visibility can be improved.

Furthermore, the needle threader is provided with the vertical moving mechanism 34 (automatic position changeover unit) having the rack and pinion mechanism 52 with the threading pulse motor 49 serving as the drive source as well as the manual operating mechanism 81 having the operation knob 89, the slider 85 and the like. Consequently, the vertical movement (displacement) and the threading operation of the needle threader can be carried out both manually and automatically (electrically), whereupon the usability of the needle threader 11 can be improved.

The following describes various modified forms of the foregoing embodiments. The vertical moving mechanism comprises the gear mechanism 50 and the rack and pinion mechanism 52 in each foregoing embodiment. However, the drive mechanism may be modified in various forms. In this case, the actuator should not be limited to the pulse motor 49. The actuator may be a DC motor, an air cylinder or a solenoid instead. The threading mechanism can be modified in various forms. Furthermore, although the needle thread cut detecting switch 47 is provided for detecting the swinging of the swing lever 76 provided on the thread cutter 45, an optical sensor such as a photo interrupter or a magnetic sensor may be employed instead. In the second embodiment, the first mode may be selected by user's operation even when an embroidering is executed.

For example, in the fourth embodiment, the reset lever may be pivotally moved by an external operation (operation of a lever or button, or the like) so that the engagement protrusion is disengaged from the cam groove (the second locking portion). In this case, since the user can arbitrarily disengage the engagement protrusion from the cam groove, the slider can be moved directly to the first position while the engagement protrusion is locked at the second locking portion. Consequently, a cam groove with a single path can be realized.

Furthermore, when the cam groove is designed so as to have a single path, the engagement protrusion is locked at the second locking portion, and the threading mechanism is once stopped at the thread guide preparation position. Thereafter, the threading mechanism is returned to the retreat position only when user's operation is effected. Accordingly, the user can select not moving the threading mechanism to the retreat position (stop at the thread guide preparation position). Consequently, troublesome work to be done by the user can be reduced when the needle thread is frequently exchanged.

In the fourth embodiment, an expected purpose can be achieved by the provision of at least the position-changeover operation unit (the manual operating mechanism 81) even without the vertical moving mechanism 34 for automatically (electrically) moving the needle threader 11. Additionally, each of the slider 85 and the needle threader 11 may be modified in various forms. Furthermore, as the construction of the sewing machine body 1, the embroidering machine 22 may or may not be provided.

The foregoing description and drawings are merely illustrative of the principles of the present invention and are not to be construed in a limiting sense. Various changes and modifications will become apparent to those of ordinary skill in the art. All such changes and modifications are seen to fall within the scope of the invention as defined by the appended claims.

What is claimed is:

1. A needle threader for a sewing machine, which is provided on a head of a sewing machine body for threading a needle by causing a needle thread from a needle thread supply to pass through an eye of a needle mounted on a lower end of a needlebar supported on a needlebar frame with a needle clamp being interposed therebetween, the needle threader comprising:

a threading shaft which is mounted on the needlebar frame so as to be vertically movable;

a threading mechanism including a threading hook provided on a lower end of the threading shaft and a thread guide member, the threading hook and the thread guide member being movable among a thread guide preparation position where the threading hook and the thread guide member are located near a height position of the needle clamp, a threading operation position where a threading operation is carried out with the threading hook being level with the eye of the needle, and a retreat position which is located above the thread guide preparation position and to which the threading hook and the thread guide member are retreated;

a vertical moving mechanism which moves the threading shaft vertically so that the threading mechanism is moved between the thread guide preparation position and the threading operation position;

a pivot mechanism which pivotally moves the threading hook when the threading mechanism is moved down to the threading operation position, so that the threading hook passes through the eye of the needle, the pivot mechanism pivotally moving the threading hook after the needle thread held by the thread guide member has been hooked by the threading hook, so that the threading hook is returned; and a position changeover unit which displaces the threading mechanism among the thread guide preparation position, the threading operation position and the retreat position.

2. A needle threader for a sewing machine, which is provided on a head of a sewing machine body for threading a needle by causing a needle thread from a needle thread supply to pass through an eye of a needle mounted on a lower end of a needlebar supported on a needlebar frame with a needle clamp being interposed therebetween, the needle threader comprising:

a threading shaft which is mounted on the needlebar frame so as to be vertically movable;

a threading mechanism including a threading hook provided on a lower end of the threading shaft and a thread guide member, the threading hook and the thread guide member being movable among a thread guide preparation position where the threading hook and the thread guide member are located near a height position of the needle clamp, a threading operation position where a threading operation is carried out with the threading hook being lever with the eye of the needle, and a retreat position which is located above the thread guide preparation position and to which the threading hook and the thread guide member are retreated;

a vertical moving mechanism which moves the threading shaft vertically so that the threading mechanism is moved between the thread guide preparation position and the threading operation position;

a pivot mechanism which pivotally moves the threading hook when the threading mechanism is moved down to the threading operation position, so that the threading hook passes through the eye of the needle, the pivot mechanism pivotally moving the threading hook after the needle thread held by the thread guide member has been hooked by the threading hook, so that the threading hook is returned; and an automatic position changeover unit which includes an actuator and a drive mechanism and displaces the threading mechanism among the thread guide preparation position, the threading operation position and the retreat position.

3. The needle threader according to claim 2, wherein the drive mechanism includes a pinion which is rotatably supported on a moving member moved vertically by the actuator, a fixed rack which is fixedly mounted on the sewing machine body so as to extend vertically and with which the pinion is brought into mesh engagement, and a movable rack which is located opposite the fixed rack with the pinion being interposed therebetween, the movable rack being vertically movable so as to be brought into mesh engagement with the pinion.

4. The needle threader according to claim 2, further comprising an operation switch which instructs positional changeover of the threading mechanism among the thread guide preparation position, the threading operation position and the retreat position, wherein the actuator of the position changeover unit is driven based on operation of the operation switch.

5. The needle threader according to claim 2, further comprising a detecting unit which detects whether or not a needle threading operation needs to be executed, wherein the threading mechanism is normally located at the retreat position by the automatic position changeover unit and when the detecting unit detects that a needle threading operation needs to be executed, the threading mechanism is moved to the thread guide preparation position by the automatic position changeover unit.

6. The needle threader according to claim 2, further comprising a mode setting unit which sets a mode in which the retreat position or the thread guide preparation position is set as a stop position of the threading mechanism.

7. The needle threader according to claim 6, wherein the sewing machine body is provided with a stitch pattern selecting unit which selects one of a plurality of stitch patterns to be sewn, wherein the mode setting unit is designed to automatically set the mode according to a type of the stitch pattern selected by the stitch pattern selecting unit.

8. A needle threader for a sewing machine, which is provided on a head of a sewing machine body for threading a needle by causing a needle thread from a needle thread supply to pass through an eye of a needle mounted on a lower end of a needlebar supported on a needlebar frame with a needle clamp being interposed therebetween, the needle threader comprising:

a threading shaft which is mounted on the needlebar frame so as to be vertically movable;

a threading mechanism including a threading hook provided on a lower end of the threading shaft and a thread guide member, the threading hook and the thread guide member being movable among a thread guide preparation position where the threading hook and the thread guide member are located near a height position of the needle clamp, a threading operation position where a threading operation is carried out with the threading hook being level with the eye of the needle, and a retreat position which is located above the threading preparation position and to which the threading hook and the thread guide member are retreated;

a vertical moving mechanism which moves the threading shaft vertically so that the threading mechanism is moved between the thread guide preparation position and the threading operation position;

a pivot mechanism which pivotally moves the threading hook when the threading mechanism is moved downward to the threading operation position, so that the threading hook passes through the eye of the needle, the pivot mechanism pivotally moving the threading hook after the needle thread held by the thread guide member has been hooked by the threading hook, so that the threading hook is returned; and a position-changeover operation unit which is manually operated so that the threading mechanism is displaced among the thread guide preparation position, the threading operation position and the retreat position.

9. The needle threader according to claim 8, wherein the position-changeover operation unit includes a threading lever moving the threading shaft vertically, a slider which is manually moved vertically thereby to move the threading lever vertically, and a locking mechanism which stops the slider at a first position corresponding to the retreat position and a second position corresponding to the thread guide preparation position.

10. The needle threader according to claim 9, wherein the locking mechanism includes an engagement protrusion engageable with the slider and a cam plate having a grooved cam which extends in an up-and-down direction and which the engagement protrusion engages thereby to be guided, wherein the grooved cam has an upper end provided with a first locking portion which locks the engagement protrusion thereby to stop the slider at the first position, an intermediate part provided with a second locking portion which locks the engagement protrusion thereby to stop the slider at the second position, and a lower end provided with a threading position which moves down the slider to a third position corresponding to the threading operation position.

11. The needle threader according to claim 10, wherein the grooved cam of the cam plate has a first path which guides the engagement protrusion so that the engagement protrusion is moved from the first locking portion to the second locking portion and further moved downward to the threading position and a second path which guides the engagement protrusion so that the engagement protrusion is returned from the threading position to the first locking portion without passing the second locking portion.

12. The needle threader according to claim 11, wherein when the slider is operated so as to be moved downward to a cancel position between the second and the third positions while the engagement protrusion is locked by the second locking portion such that the slider is stopped at the second position, the engagement protrusion is moved from the first path to the second path and is then returned to the first locking portion, whereby the slider is returned to the first position.

13. The needle threader according to claim 10, further comprising a reset unit which releases the engagement protrusion from engagement with a cam groove.

14. The needle threader according to claim 8, further comprising a threading lever which moves the threading shaft vertically and an automatic position changeover unit which automatically displaces the threading mechanism among the thread guide preparation position, the threading operation position and the retreat position.

* * * * *